US006926571B2

(12) United States Patent
Ito et al.

(10) Patent No.: US 6,926,571 B2
(45) Date of Patent: Aug. 9, 2005

(54) METHOD OF MANUFACTURING SPACER, METHOD OF MANUFACTURING IMAGE FORMING APPARATUS USING SPACER, AND APPARATUS FOR MANUFACTURING SPACER

(75) Inventors: Nobuhiro Ito, Sagamihara (JP); Kunihiro Sakai, Isehara (JP); Masahiro Fushimi, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 272 days.

(21) Appl. No.: 10/265,232

(22) Filed: Oct. 7, 2002

(65) Prior Publication Data

US 2003/0045199 A1 Mar. 6, 2003

Related U.S. Application Data

(62) Division of application No. 09/399,811, filed on Sep. 21, 1999, now Pat. No. 6,517,399.

(30) Foreign Application Priority Data

Sep. 21, 1998 (JP) ..... 10-266965
Sep. 16, 1999 (JP) ..... 11-262674

(51) Int. Cl.[7] ..... H01J 9/00
(52) U.S. Cl. ..... 445/24; 445/25; 445/14
(58) Field of Search ..... 445/24, 25; 313/495, 313/292

(56) References Cited

U.S. PATENT DOCUMENTS

| | | | |
|---|---|---|---|
| 3,843,472 A | 10/1974 | Trussaint et al. | 216/33 |
| 4,904,895 A | 2/1990 | Tsukamoto et al. | 313/336 |
| 4,923,421 A | 5/1990 | Brodie et al. | 445/24 |
| 5,063,327 A | 11/1991 | Brodie et al. | 313/482 |
| 5,066,883 A | 11/1991 | Yoshioka et al. | 313/309 |
| 5,205,770 A | 4/1993 | Lowrey et al. | 445/24 |

(Continued)

FOREIGN PATENT DOCUMENTS

| | | |
|---|---|---|
| EP | 0 725 416 | 8/1996 |
| EP | 0 725 417 | 8/1996 |
| EP | 0 725 418 | 8/1996 |
| EP | 0 725 419 | 8/1996 |
| JP | 57-118355 | 7/1982 |
| JP | 61-124031 | 6/1986 |
| JP | 64-31332 | 2/1989 |
| JP | 2-257551 | 10/1990 |
| JP | 3-55738 | 3/1991 |
| JP | 4-28137 | 1/1992 |
| JP | 8-180821 | 7/1996 |
| WO | WO 94/18694 | 8/1994 |
| WO | WO 96/30926 | 10/1996 |
| WO | WO 98/02899 | 1/1998 |
| WO | WO 98/03986 | 1/1998 |
| WO | WO 98/28774 | 7/1998 |

OTHER PUBLICATIONS

M.I. Elinson, et al., "The Emission of Hot Electrons and the Field Emission of Electrons From Tin Oxide", Radio Engineering and Electronic Physics, pp. 1290–1296 (Jul. 1965).
G. Dittmer, "Electrical Conduction and Electron Emission of Discontinuous Thin Films", Thin Solid Films, No. 9, pp. 317–329 (1972), no month.

(Continued)

*Primary Examiner*—Mariceli Santiago
(74) *Attorney, Agent, or Firm*—Fitzpatrick, Cella, Harper & Scinto

(57) ABSTRACT

A method of manufacturing a spacer having a low-resistance film without using any exhaust device, and being interposed between a first substrate having an image forming member and a second substrate having an electron-emitting device. The method including the steps of preparing a spacer substrate with an edge including a tapered, chamfered or arcuated portion, preparing a liquid comprising a dispersed conductive material or dissolved conductive material, dipping the edge into the liquid, and drying and/or baking the spacer substrate after the dipping step.

26 Claims, 33 Drawing Sheets

U.S. PATENT DOCUMENTS

| | | | | | |
|---|---|---|---|---|---|
| 5,232,549 | A | | 8/1993 | Cathey et al. | 456/633 |
| 5,486,126 | A | | 1/1996 | Cathey et al. | 445/25 |
| 5,509,140 | A | | 4/1996 | Koitabashi et al. | 347/86 |
| 5,561,343 | A | | 10/1996 | Lowe | 313/482 |
| 5,614,781 | A | | 3/1997 | Spindt et al. | 313/422 |
| 5,667,897 | A | | 9/1997 | Hashemi et al. | 65/97 |
| 5,675,212 | A | | 10/1997 | Schmid et al. | 313/422 |
| 5,717,287 | A | * | 2/1998 | Amrine et al. | 445/24 |
| 5,721,050 | A | | 2/1998 | Roman et al. | 428/397 |
| 5,742,117 | A | | 4/1998 | Spindt et al. | 313/422 |
| 5,746,635 | A | | 5/1998 | Spindt et al. | 445/24 |
| 5,777,432 | A | | 7/1998 | Xie | 313/495 |
| 5,811,927 | A | * | 9/1998 | Anderson et al. | 445/24 |
| 5,893,788 | A | * | 4/1999 | Makita et al. | 445/63 |
| 5,939,822 | A | * | 8/1999 | Alderson | 313/495 |
| 6,068,532 | A | * | 5/2000 | Lai et al. | 445/24 |
| 6,494,757 | B2 | * | 12/2002 | Yamazaki et al. | 445/24 |
| 6,761,606 | B2 | * | 7/2004 | Ito et al. | 445/24 |

OTHER PUBLICATIONS

M. Hartwell, et al., "Strong Electron Emission From Patterned Tin–Indium Oxide Thin Films", International Electron Devices Meeting, pp. 519–520 (1975), no month.

H. Araki, et al., "Electroforming and Electron Emission of Carbon Thin Films", Journal of the Vacuum Society of Japan, vol. 26, No. 1, pp. 22–29 (Jan. 26, 1983).

C.A. Spindt, et al., Physical Properties of Thin–Film Field Emission Cathodes with Molybdenum Cones, Journal of Applied Physics, vol. 47, No. 12, pp. 5248–5263 (Dec. 1976).

W.P. Dyke, et al., "Field Emission", Advances in Electronics and Electron Physics, vol. VIII, pp. 89–185 (1956), no month.

C.A. Mead, "Operation of Tunnel–Emmission Devices", Journal of Applied Physics, vol. 32, No. 4, pp. 646–652 (Apr. 1961).

R. Meyer, et al., "Recent Development on Microtips Display at LETI", Tech. Digest of 4$^{th}$ Int. Vacuum Microelectronics Conference, pp. 6–9 (1991), no month.

* cited by examiner

IMMEDIATELY AFTER FORMING ELECTRODE (LOW-RESISTANCE FILM)

AFTER PROCESSING (REMOVING) ELECTRODE (LOW-RESISTANCE FILM)

METHOD OF MANUFACTURING SPACER, METHOD OF MANUFACTURING IMAGE FORMING APPARATUS USING SPACER, AND APPARATUS FOR MANUFACTURING SPACER

This is a divisional application of application Ser. No. 09/399,811, filed on Sep. 21, 1999, now U.S. Pat. No. 6,517,399.

BACKGROUND OF THE INVENTION

1. Field of the Invention

The present invention relates to a method of manufacturing a spacer for supporting a pair of substrates, a method of manufacturing an image forming apparatus using the spacer, and an apparatus for manufacturing the spacer.

2. Description of the Related Art

Conventionally, two types of devices, namely thermionic and cold cathodes, are known as electron-emitting devices. Known examples of the cold cathodes are surface-conduction emission type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio Eng. Electron Phys., 10, 1290 (1965) and other examples will be described later.

The surface-conduction emission type electron-emitting device utilizes the phenomenon that electrons are emitted by a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 20 is a plan view showing the device by M. Hartwell et al. described above as a typical example of the device structures of these surface-conduction emission type electron-emitting devices. Referring to FIG. 20, reference numeral 3001 denotes a substrate; and 3004, a conductive thin film made of a metal oxide formed by sputtering. This conductive thin film 3004 has an H-shaped pattern, as shown in FIG. 20. An electron-emitting portion 3005 is formed by performing electrification processing (referred to as forming processing to be described later) with respect to the conductive thin film 3004. An interval L in FIG. 20 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction emission type electron-emitting devices by M. Hartwell et al. and the like, typically the electron-emitting portion 3005 is formed by performing electrification processing called forming processing for the conductive thin film 3004 such that electrons are emitted from the portion 3005. In forming processing, a constant DC voltage or a DC voltage which increases at a very low rate of, e.g., 1 V/min is applied across the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 21 is a sectional view showing the device by C. A. Spindt et al. described above as a typical example of the FE type device structure. In FIG. 21, reference numeral 3010 denotes a substrate; 3011, an emitter wiring made of a conductive material; 3012, an emitter cone; 3013, an insulating layer; and 3014, a gate electrode. In this device, a voltage is applied between the emitter cone 3012 and gate electrode 3014 to emit electrons from the distal end portion of the emitter cone 3012.

As another FE type device structure, there is an example in which an emitter and gate electrode are arranged on a substrate to be almost parallel to the surface of the substrate, in addition to the multilayered structure of FIG. 21.

A known example of the MIM type electron-emitting devices is described in C. A. Mead, "Operation of Tunnel-Emission Devices", J. Appl. Phys., 32,646 (1961).

FIG. 22 shows a typical example of the MIM type device structure. FIG. 22 is a sectional view of the MIM type electron-emitting device. In FIG. 22, reference numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper and lower electrodes 3023 and 3021 to emit electrons from the surface of the upper electrode 3023.

Since the above-described cold cathodes can emit electrons at a temperature lower than that for thermionic cathodes, they do not require any heater. The cold cathode has a structure simpler than that of the thermionic cathode and can shrink in feature size. Even if a large number of devices are arranged on a substrate at a high density, problems such as heat fusion of the substrate hardly arise. In addition, the response speed of the cold cathode is high, while the response speed of the thermionic cathode is low because thermionic cathode operates upon heating by a heater.

For this reason, applications of the cold cathodes have enthusiastically been studied.

Of cold cathodes, the surface-conduction emission type electron-emitting devices have a simple structure and can be easily manufactured, and thus many devices can be formed on a wide area. As disclosed in Japanese Patent Laid-Open No. 64-31332 filed by the present applicant, a method of arranging and driving a lot of devices has been studied.

Regarding applications of the surface-conduction emission type electron-emitting devices to, e.g., image forming apparatuses such as an image display apparatus (display) and image recording apparatus, charge beam sources, and the like have been studied.

Particularly as an application to image display apparatuses, as disclosed in the U.S. Pat. No. 5,066,883 and Japanese Patent Laid-Open Nos. 2-257551 and 4-28137 filed by the present applicant, an image display apparatus using a combination of an surface-conduction emission type electron-emitting device and a fluorescent substance which emits light upon collision with electrons has been studied. This type of image display apparatus using a combination of the surface-conduction emission type electron-emitting device and fluorescent substance is expected to exhibit more excellent characteristics than other conventional image display apparatuses. For example, compared with recent popular liquid crystal display apparatuses, the above display apparatus is superior in that it does not require any backlight because it is of a emissive type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat panel display reported by R. Meyer et al. [R. Meyer: "Recent Development on Microtips Display at LETI", Tech. Digest of 4th Int. Vacuum Microelectronics Conf., Nagahama, pp. 6–9 (1991)].

An example of an application of a larger number of MIM type electron-emitting devices arranged side by side to an image display apparatus is disclosed in Japanese Patent Laid-Open No. 3-55738 filed by the present applicant.

Of these image forming apparatuses using electron-emitting devices, a flat panel display is space-saving and lightweight, and thus receives a great deal of attention as a substitute for an image display apparatus of a cathode ray tube type.

There is proposed a flat panel display in which an electron source obtained by arranging electron-emitting devices in a matrix is housed in an airtight container. This airtight container is constituted such that a face plate having fluorescent substances and a rear plate having the electron source are made to face each other and sealed. The interior of the airtight container is kept at a vacuum of about $10^{-6}$ Torr. As the display area of the image display apparatus increases, demand is arising for a means for preventing deformation or destruction of the rear plate and face plate caused by the difference between inner and outer pressures of the airtight container. Thus, a structure support (to be referred to as a spacer or rib) made of a relatively thin glass plate to stand the atmospheric pressure is conventionally interposed between the rear plate and face plate.

A method of manufacturing a spacer to be interposed between a pair of substrates constituting an image forming apparatus is disclosed in U.S. Pat. No. 4,923,421, U.S. Pat. No. 5,063,327, U.S. Pat. No. 5,205,770, U.S. Pat. No. 5,232,549, U.S. Pat. No. 5,486,126, U.S. Pat. No. 5,509,840, and U.S. Pat. No. 5,721,050, EP-A-0725416, EP-A-0725417, EP-A-0725418, EP-A-0725419, and the like.

However, the image forming apparatus and flat panel display using the above-described spacer suffer the following problems.

First, when some of electrons emitted by an electron-emitting device near the spacer collide against the spacer, or ions produced owing the effect of emitted electrons are attached to the spacer, the spacer may be charged. The orbits of electrons emitted by the electron-emitting device are deflected by charge-up of the spacer. As a result, the electrons reach positions different from correct positions on the fluorescent substances of the face plate to display a distorted image near the spacer.

Second, since a high voltage Va of several hundred V or more (e.g., a high electric field of 1 kV/mm or more) is applied between the rear plate and face plate in order to accelerate electrons emitted by the electron-emitting device. This may cause surface discharge on the spacer surface. If the spacer is charged in the above manner, discharge may be induced.

To solve these problems, there is proposed a method of flowing a small current through the spacer to remove charges (Japanese Patent Laid-Open Nos. 57-118355 and 61-124031). According to this method, a high-resistance film is formed on the surface of an insulating spacer substrate to flow a small current through the spacer surface. The high-resistance film used here is made of tin oxide, a mixed crystal of tin oxide and indium oxide, or a metal.

However, when the electron-emitting duty is high, image distortion cannot be satisfactorily reduced depending on the type of image only by the method of removing charges using the high-resistance film. This problem arises when the high-resistance film, and upper and lower substrates, i.e., a face plate (to be referred to as an FP) and rear plate (to be referred to as an RP) are not sufficiently electrically connected, and charges concentrate around the connected portions.

To solve this problem, as shown in FIG. 23, films (electrodes) 25 lower in resistance than a high-resistance film 22 are formed on the side surface of an insulating spacer substrate 21 and its end surfaces in contact with a face plate 17 and rear plate 11. The low-resistance films (electrodes) 25 can ensure electrical contact between the upper and lower substrates 17 and 11 and high-resistance film 22. FIG. 23 shows the low-resistance films (electrodes) 25 formed on the end surfaces in contact with the face plate 17 and rear plate 11, sand the side surface in contact with these end surfaces. FIG. 23 is a sectional view showing the spacer when a section perpendicular to the rear plate plane is taken along a spacer-including plane.

If Va is set low without forming any high-resistance film 22, or the shape of the side surface of the insulating spacer substrate 21 is controlled, the first and second problems may be solved even in a spacer whose insulator is exposed in vacuum. In this case, however, when the potential of the end surface of the insulating spacer substrate 21 is varied, the orbits of emitted electrons may also vary. To prevent this, as shown in FIG. 27, even if the insulating spacer is interposed between the face plate and rear plate, the electrode (low-resistance film) 25 must be formed on at least one end surface of the spacer.

FIG. 24 is a schematic sectional view taken along the line A—A when the spacer substrate 21 in FIG. 23 is flat (plate). FIG. 25 is a schematic enlarged view showing an RP-side end portion B of the spacer circled in FIGS. 23 and 27. In FIG. 25, for descriptive convenience, no high-resistance film is formed on the surface of the spacer substrate 21. FIG. 26 is a perspective view schematically showing the spacer substrate 21 when the spacer substrate 21 is flat (plate). FIG. 31 is a perspective view when the spacer substrate 21 is columnar. When the spacer substrate is columnar, an end surface diameter R corresponds to a length L and thickness D of the flat spacer substrate.

The present invention discriminates the term "spacer" from the term "spacer substrate". The "spacer substrate" has any film (e.g., the high-resistance film 22 or low-resistance film 25) on the surface, as shown in FIG. 23. On the other hand, the "spacer" generally means a member interposed between the face plate 17 and rear plate 11 so as to support them, and has at least the spacer substrate and low-resistance film (electrode).

A method of forming a metal film or high-conductivity material film on the end surface of a spacer is disclosed in Japanese Patent Laid-Open No. 8-180821, U.S. Pat. No. 5,561,343, U.S. Pat. No. 5,614,781, U.S. Pat. No. 5,675,212, U.S. Pat. No. 5,746,635, U.S. Pat. No. 5,742,117, U.S. Pat. No. 5,777,432, WO 94/18694A, WO 96/30926A, WO 98/02899A, WO 98/03986A, WO 98/28774A, and the like.

These references disclose various methods such as sputtering, resistance heating evaporation, coating, dipping, and printing as the method of forming a metal film or high-conductivity material film on the end surface of a spacer.

Of these formation methods, a method (liquid phase formation method) such as coating, dipping, or printing of coating a spacer with a liquid and sintering the spacer can preferably easily form the low-resistance film (electrode) 25 at low cost.

However, if the low-resistance film (electrode) 25 is formed on the spacer substrate 21 simply using the liquid phase formation method, the following problems may occur.

By the liquid phase formation method, the formation state of the low-resistance film (electrode) 25 greatly depends on the surface shape of the spacer substrate 21.

Particularly when the spacer substrate 21 has an edge of an almost right angle, as shown in FIGS. 26 and 31, the low-resistance film (electrode) 25 cannot be satisfactorily formed at the edge. More specifically, the low-resistance film (electrode) 25 may become thin at the edge during film formation to expose part of the high-resistance film or the insulating spacer substrate 21. As a result, electron orbits near the connected portions between the spacer, RP, and FP may shift from desired orbits.

SUMMARY OF THE INVENTION

It is, therefore, an object of the present invention to provide the structure of a spacer substrate, a method of manufacturing the spacer substrate, a method of forming a low-resistance film (electrode) on the spacer substrate, and an apparatus for manufacturing the spacer, all of which are free from the above problems.

To achieve the above object, the present invention comprises the following steps.

That is, according to one aspect of the present invention, there is provided a method of manufacturing a spacer interposed between a first substrate having an image forming member and a second substrate having an electron-emitting device, comprising the steps of preparing a glass (glass preform, glass plate, mother glass), stretching part of the glass preform while heating the glass by a heater, and cutting the stretched glass into a desired length, wherein the stretching step has the step of feeding the glass at a velocity v1 toward the heater, and stretching the glass heated by the heater in a direction away from the heater at a velocity v2, and the velocities v1 and v2 have different speeds and satisfy a relation: v1<v2.

This manufacturing method can easily form a large number of low-cost spacer substrates each having an arcuated edge.

According to another aspect of the present invention, there is provided a method of manufacturing an image forming apparatus having a first substrate with an image forming member, a second substrate having an electron-emitting device, and a spacer interposed between the first and second substrates, comprising the steps of preparing a spacer preform, processing an edge of the spacer preform into a flat or arcuated portion to form a spacer substrate, applying a conductive material-dispersed or conductive material-dissolved liquid to an end portion of the spacer substrate including the tapered or arcuated portion, heating the liquid applied to the spacer substrate to form an electrode at the end portion of the spacer substrate, and bringing the electrode formed on the spacer substrate into contact with the first or second substrate.

According to still another aspect of the present invention, there is provided a method of manufacturing an image forming apparatus having a first substrate with an image forming member, a second substrate having an electron-emitting device, and a spacer interposed between the first and second substrates, comprising the steps of preparing a spacer preform, processing an end portion of the spacer preform into a tapered or arcuated portion to form a spacer substrate, applying a conductive material-dispersed or conductive material-dissolved liquid to the end portion of the spacer substrate including the tapered or arcuated portion, heating the liquid applied to the spacer substrate to form an electrode at the end portion of the spacer substrate, and bringing the electrode formed on the spacer substrate into contact with the first or second substrate.

According to these manufacturing methods, a low-resistance film can be appropriately formed at the end portion of a spacer substrate by a liquid phase formation method. As a result, the methods can provide an image forming apparatus capable of displaying a high-quality image, and can suppress any discharge for a long time so that the orbits of electrons emitted from an electron-emitting device are kept stable.

According to still another aspect of the present invention, there is provided an apparatus for manufacturing a spacer interposed between a first substrate having an image forming member and a second substrate having an electron-emitting device, comprising heating means for heating a glass, first feed means for feeding the glass to the heating means, and second feed means for drawing the glass from the heating means, the heating means being interposed between the first and second feed means.

This spacer manufacturing apparatus can easily form a large number of low-cost spacers each having a small radius of curvature at high precision.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Figure 25:
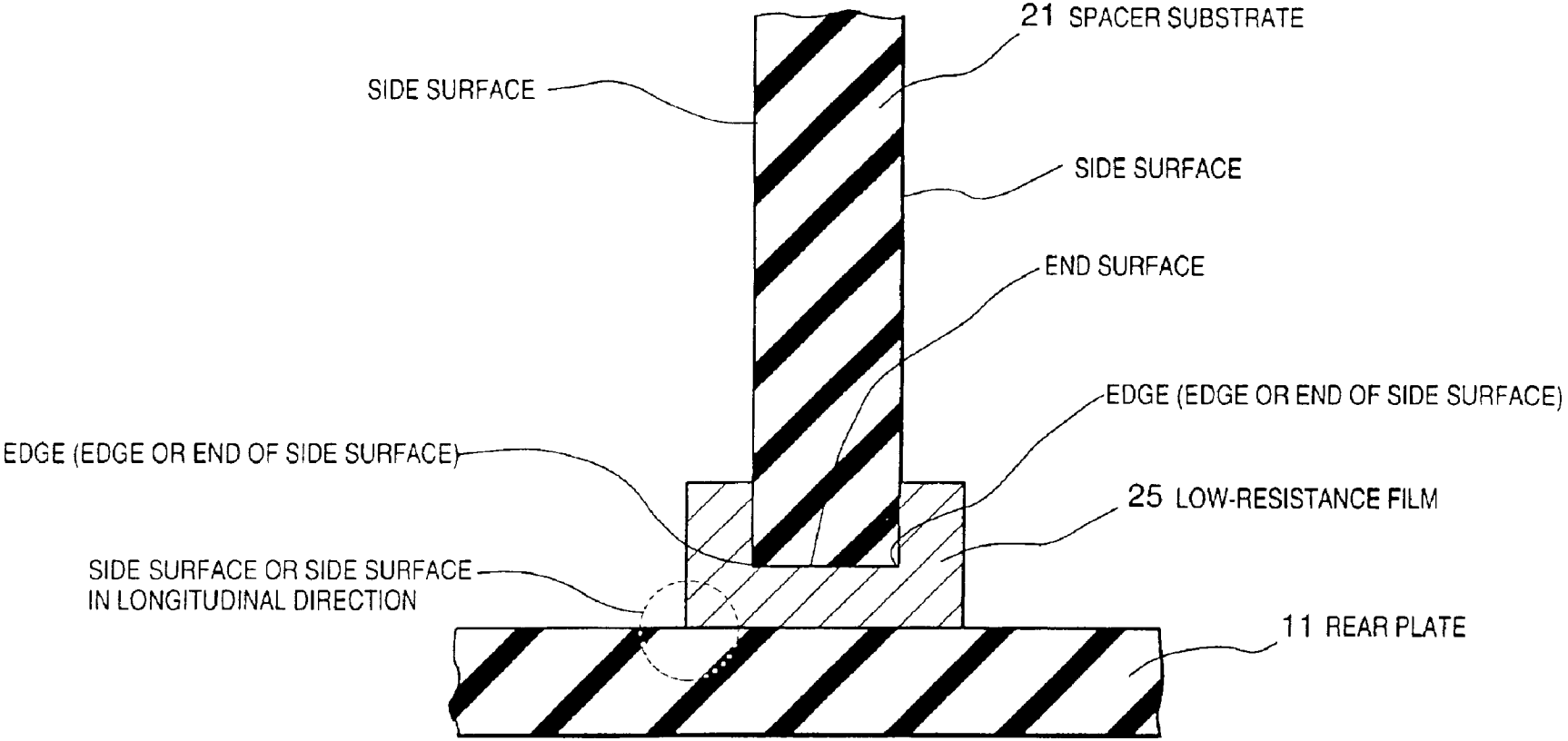
FIG. 25 is a schematic view showing the end portion of the spacer.

The present invention forms low-resistance film (electrode) 25 on the end portion of a spacer substrate 21, as shown in FIG. 25.

The low-resistance film (electrode) 25 in the present invention desirably has a sheet resistance of $10^7$ Ω/□ or less.

According to the present invention, good film continuity between the low-resistance films (electrodes) formed on the end surface and side surface of the spacer substrate 21 can be ensured by adopting the following method ① and/or ② in the liquid phase formation method.

More specifically,

① A spacer substrate having tapered or arcuated end portion is used.

② The liquid phase formation method uses a conductive material-containing liquid having a viscosity of 10 cps or more in dipping (to be described below).

In the present invention, the liquid phase formation method means the process of coating the end portion (end surface and side surface) of the spacer substrate 21 with a liquid in which a conductive material for forming the low-resistance film 25 is dispersed or dissolved, and heating and sintering the liquid to form the low-resistance film (electrode).

The method ① will be described.

Figure 26:
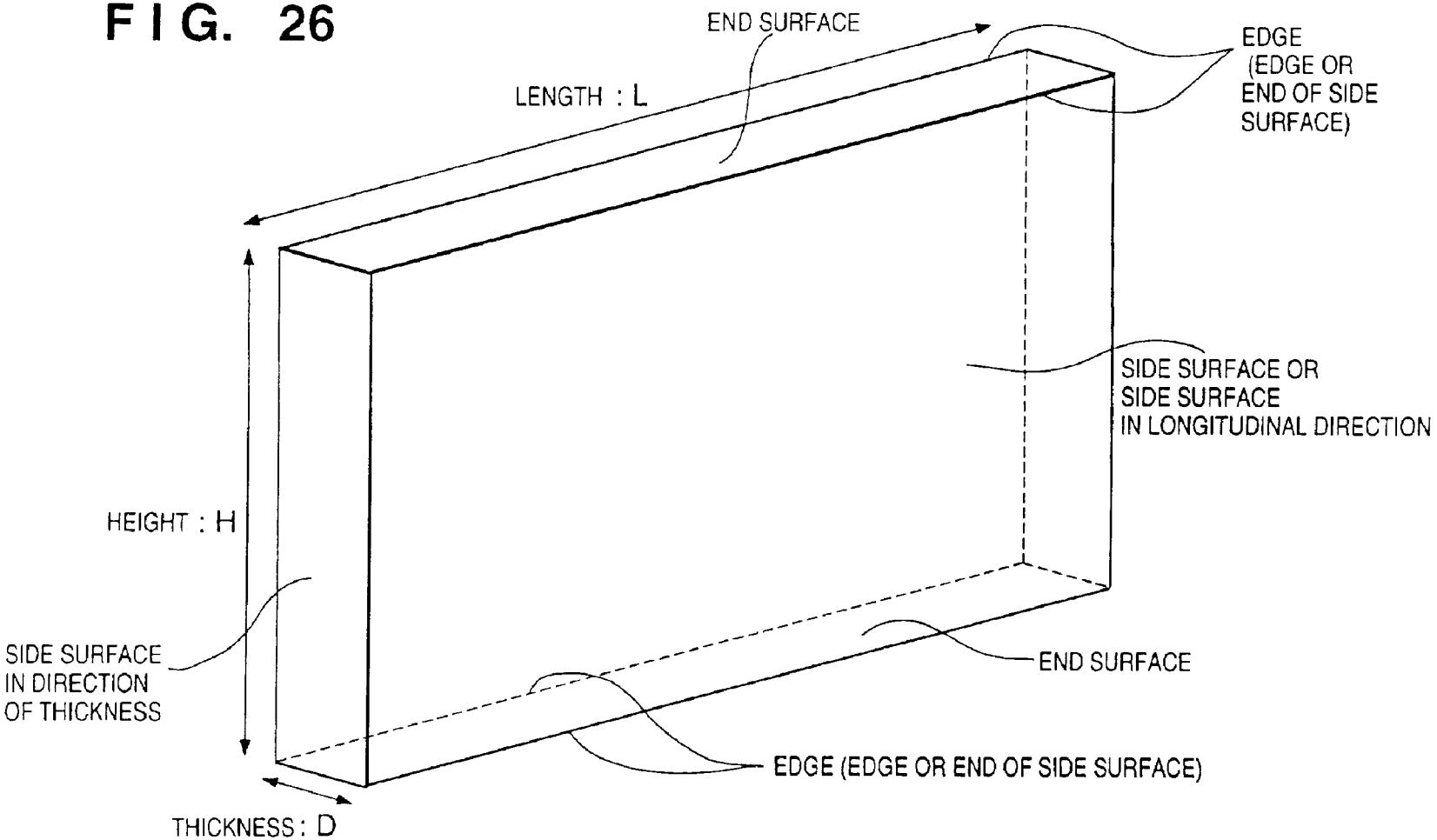
FIG. 26 is a perspective view showing a spacer substrate or spacer.
Figure 31:
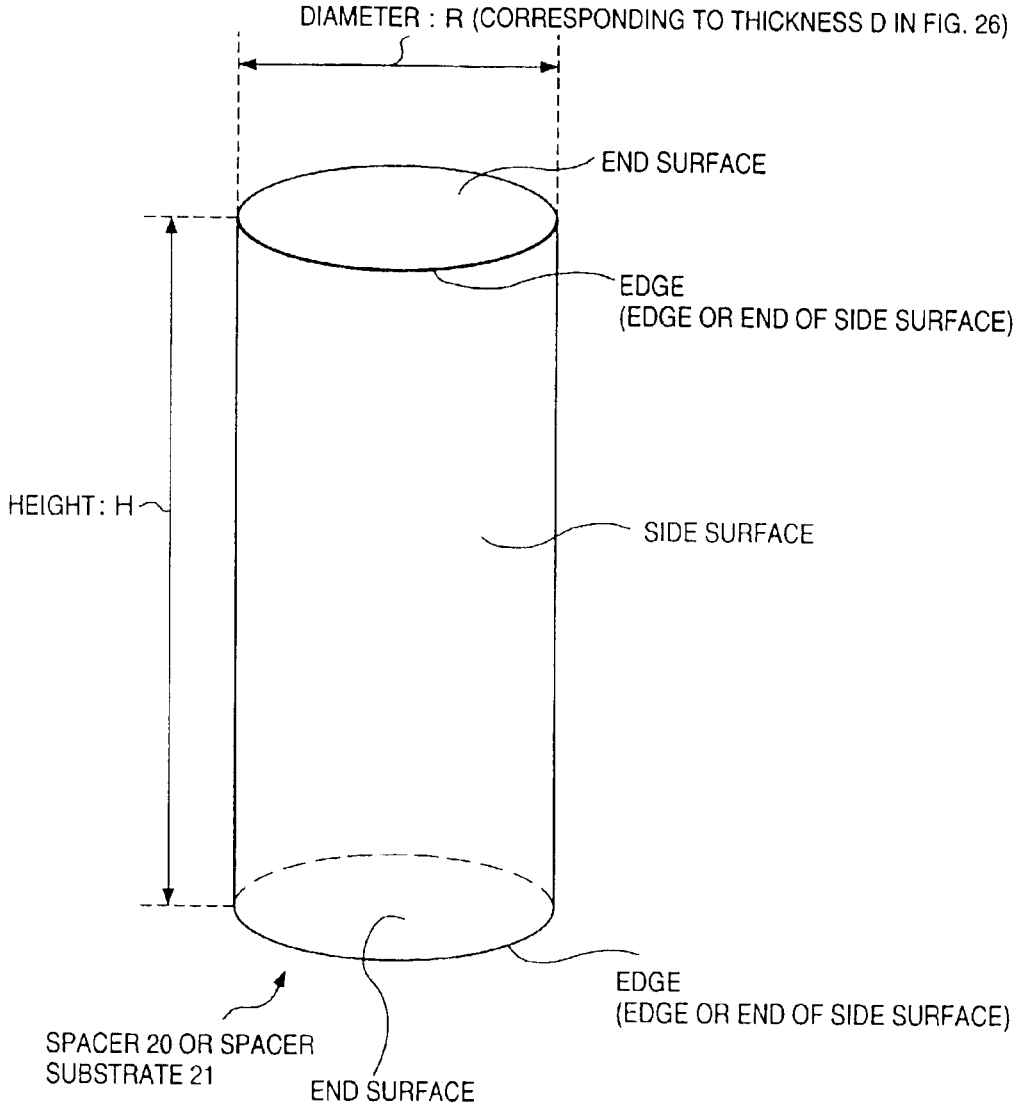
FIG. 31 is a perspective view showing the spacer substrate or spacer.

As described above, if the low-resistance film (electrode) 25 is formed at a right- or acute-angle end portion of the spacer substrate 21 using the liquid phase formation method, as shown in FIGS. 25, 26, and 31, the low-resistance film 25 may not be satisfactorily formed at the edge.

The present inventors have made extensive studies to find that this problem can be solved by forming the edge at an obtuse angle, as shown in FIGS. 3A to 3D.

FIGS. 3A to 3H are schematic views, respectively, showing the end portion (FIGS. 3A to 3D) of the spacer substrate 21 preferably applied to the present invention, and the low-resistance film (electrode) 25 formed on the spacer end portion (FIGS. 3E to 3H). Note that FIGS. 3A to 3H are sectional views of the spacer end portion when a section perpendicular to the rear plate (or face plate) plane is taken along a spacer-including plane, similar to the spacer end portion shown in FIG. 25. When the spacer substrate is flat, the sectional views in FIGS. 3A to 3H, 4, 23, 25, and 27 show a portion of the spacer substrate having a thickness D (minimum). When the spacer substrate 21 is columnar, as shown in FIG. 31, the sectional view in FIG. 31 corresponds to the sectional view taken along a plan including the center of the end surface of the spacer substrate 21.

In other words, according to the method ①, the surface area of the spacer substrate 21 covered with the low-resistance film (electrode) 25 is made smaller than the spacer substrate 21 (FIGS. 25 and 26) having an edge of an almost right angle. In terms of ensuring the spacer assembly precision and reliably electrically connecting an FP 17 and/or RP11 and the low-resistance film (electrode) 25, the area of the end surface (surface almost parallel to the FP or RP) of the spacer substrate must be ensured.

Figure 4:
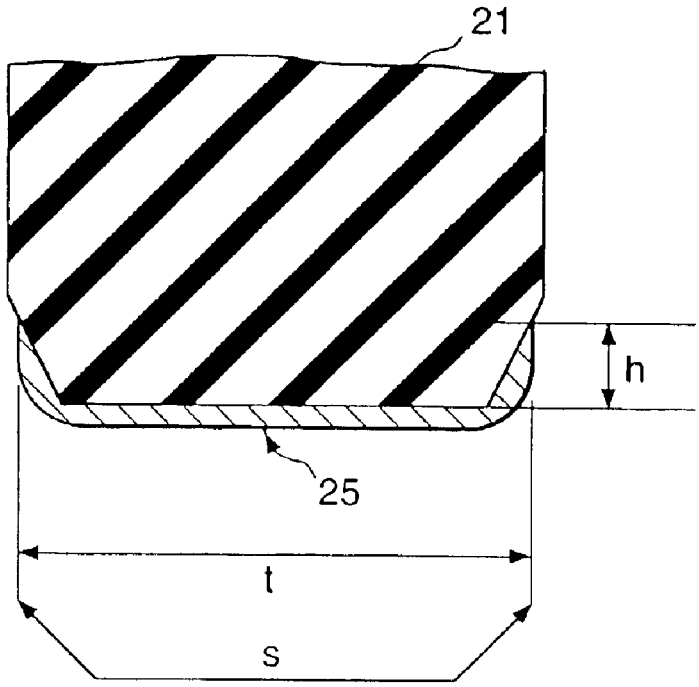
FIG. 4 is a view showing the size of the low-resistance film formation portion of the spacer according to the embodiment.

From these requirements, the shape of the end portion of the spacer substrate 21 desirably satisfies inequality (1):

$$(t^2+4\times h^2)<s^2<(t+2h)^2 \quad (1)$$

where t: the maximum thickness value at a portion of the spacer substrate 21 covered with the low-resistance film 25 in the sectional view (FIG. 4) of the spacer substrate. Note that the thickness is the minimum length of the substrate on the section when the spacer substrate is taken along a plane almost parallel to the FP or RP.

h: the approximation of the height of the low-resistance film in the sectional view (FIG. 4) of the spacer substrate, and more strictly, the length (=height) of the low-resistance film 25 in a direction perpendicular to the rear plate (or face plate) plane from the end surface of the spacer substrate.

s: the inner surface length of the section of the low-resistance film, i.e., the length of a portion of the spacer substrate surface covered with the low-resistance film 25 in the sectional view (FIG. 4).

A practical method for obtaining an end portion shape satisfying these requirements is not particularly limited.

Figure 28:
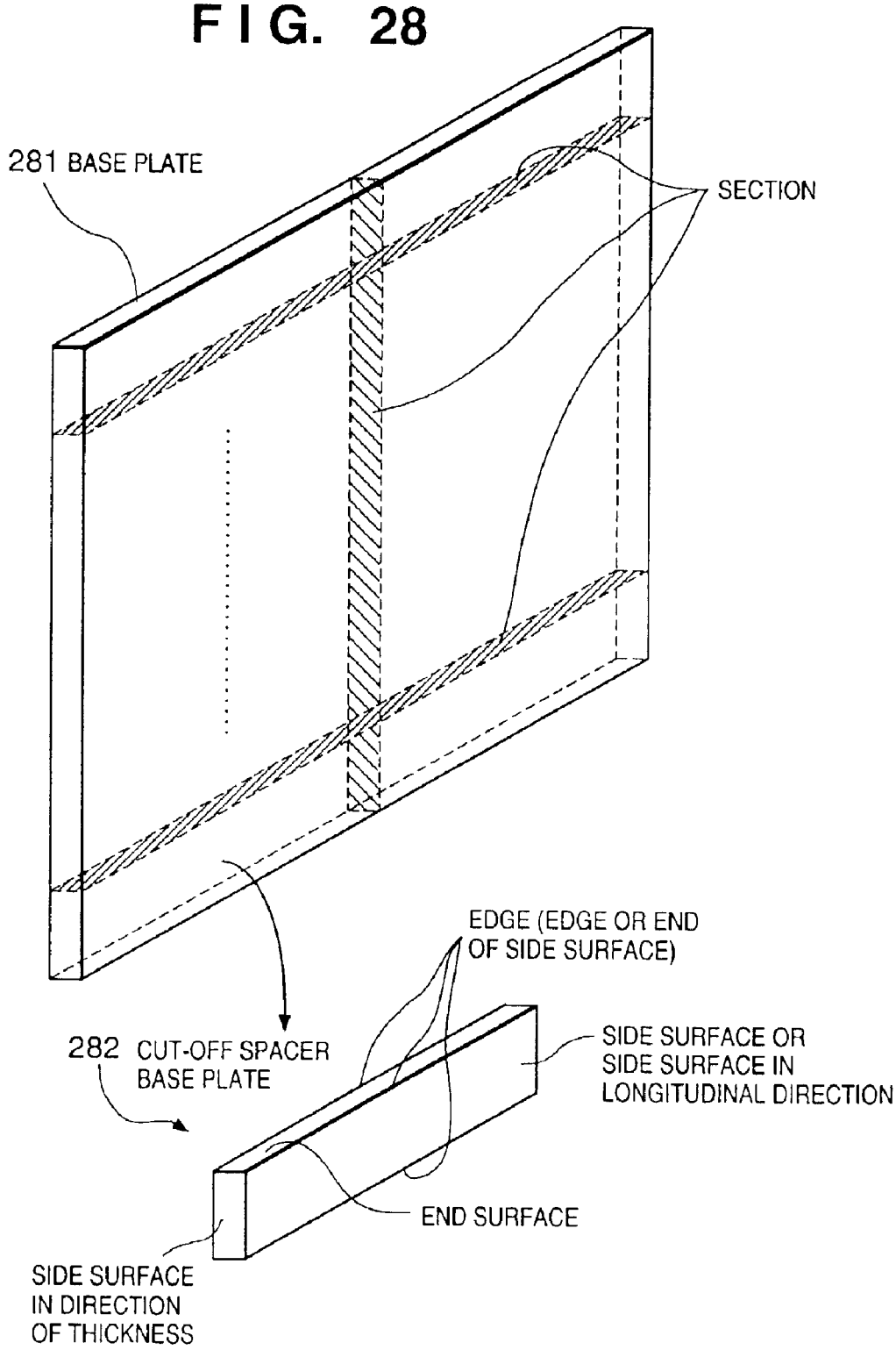
FIG. 28 is a schematic view showing a method of cutting off a spacer preform from a preform.
Figure 29A:
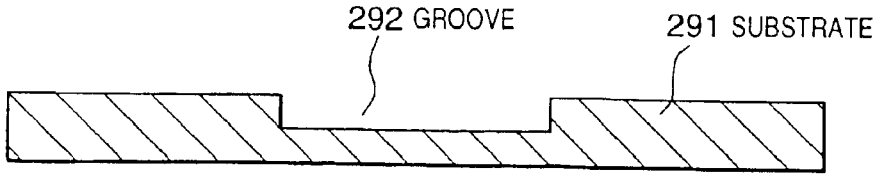
FIGS. 29A to 29E are sectional views, respectively, showing an example of a method of forming an electrode on the spacer substrate according to the present invention.
Figure 29B:
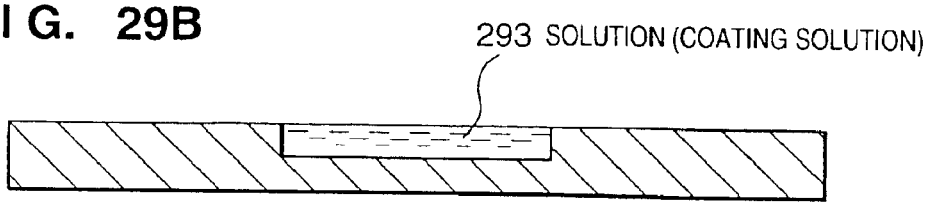
Figure 29C:
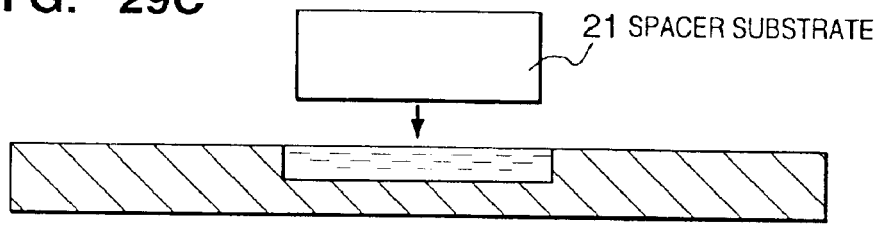
Figure 29D:
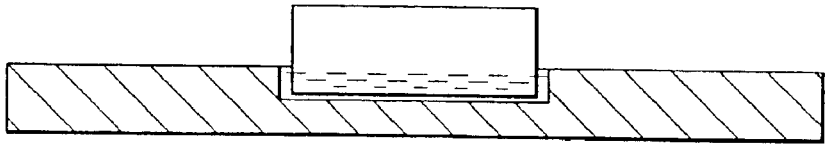
Figure 29E:
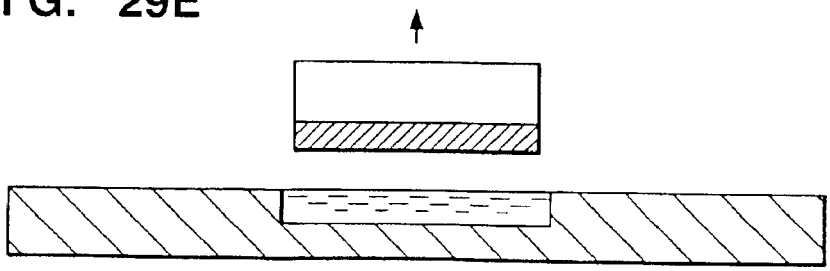

For example, when a flat spacer substrate 21 like the one shown in FIG. 26 is to be used, a glass plate (preform) 281 like the one shown in FIG. 28 having the same thickness D as the spacer substrate is cut into a preform (to be referred to as a "spacer preform") 282 for the spacer substrate with a diamond cutter or the like. By this cut-out, the spacer preform 282 having the thickness D, height H, and length L as shown in FIG. 26 can be prepared.

The edge of the spacer preform 282 undergoes end portion processing as shown in FIGS. 3A to 3D. More specifically, an acute portion is removed from the edge of the spacer preform by processing (FIG. 3D) of forming the edge into an arcuated shape, or processing (FIGS. 3A to 3C) of tapering (flattening) the edge. By this end portion processing, the edge of the spacer preform can be made obtuse. Examples of the end portion processing are sandblasting, laser scribing, water blasting, scribe cutting, polishing, and chemical etching using hydrofluoric acid or the like.

In arcuated-shape processing (FIG. 3D) for the edge of the spacer preform 282, a radius r of curvature is preferably equal to D/2 or less the thickness D of the spacer preform 282. More preferably, if the radius r of curvature is D×1/100 or more, continuity of the low-resistance film (electrode) 25 and spacer assembly precision can be satisfied. The thickness D ranges preferably from 10 μm to 500 μm, and more preferably from 20 μm to 200 μm. Therefore, the radius r of curvature ranges preferably from 0.1 μm to 250 μm, and more preferably from 0.2 μm to 100 μm.

Figure 3A:
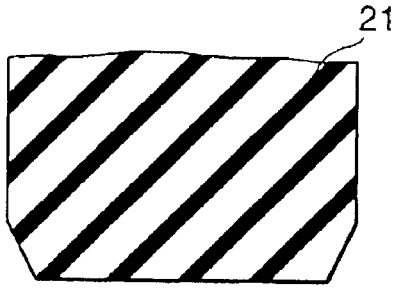
FIGS. 3A to 3H are views for explaining the sectional shape of the spacer substrate and the applied state of the low-resistance film according to the embodiment.
Figure 3B:
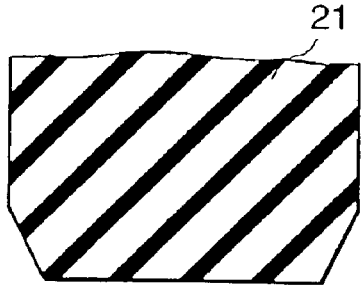
Figure 3C:
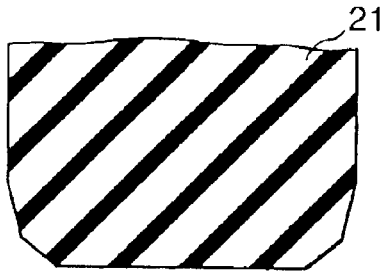
Figure 3D:
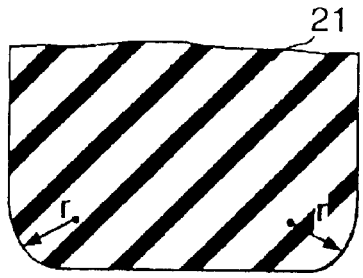
Figure 3E:
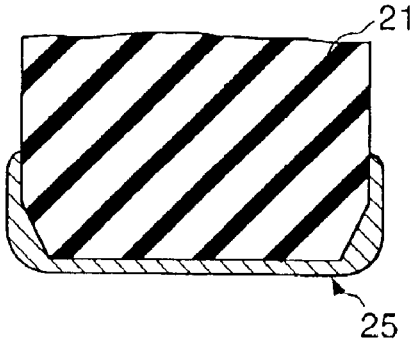
Figure 3F:
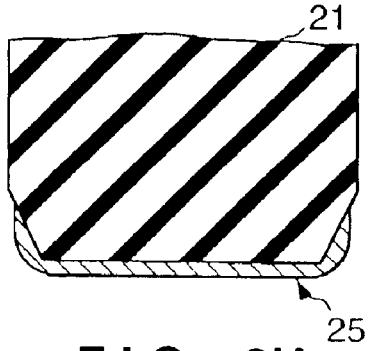
Figure 3G:
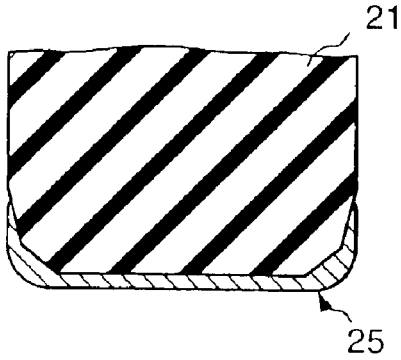
Figure 3H:
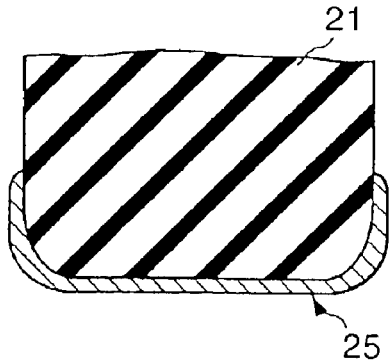

FIGS. 3A to 3D are sectional views showing an example of the sectional shape of the spacer applicable to an embodiment of the present invention. FIGS. 3A and 3B show the shapes of the edge of the spacer preform 282 chamfered in one direction. FIG. 3C shows the shape chamfered in two directions, and FIG. 3D shows an arcuated shape. FIGS. 3E to 3H show examples of the low-resistance film (electrode) 25 respectively formed in correspondence with FIGS. 3A to 3D.

To form a flat spacer substrate 21 with an end portion as shown in FIG. 3D from like the glass shown in FIG. 26, a heating/stretching method is applied more preferably than the cut-out method shown in FIG. 28. The heating/stretching method can simultaneously perform formation of the spacer preform 282 and end surface processing (processing the edge into a shape having the above-described radius of curvature).

Figure 30:
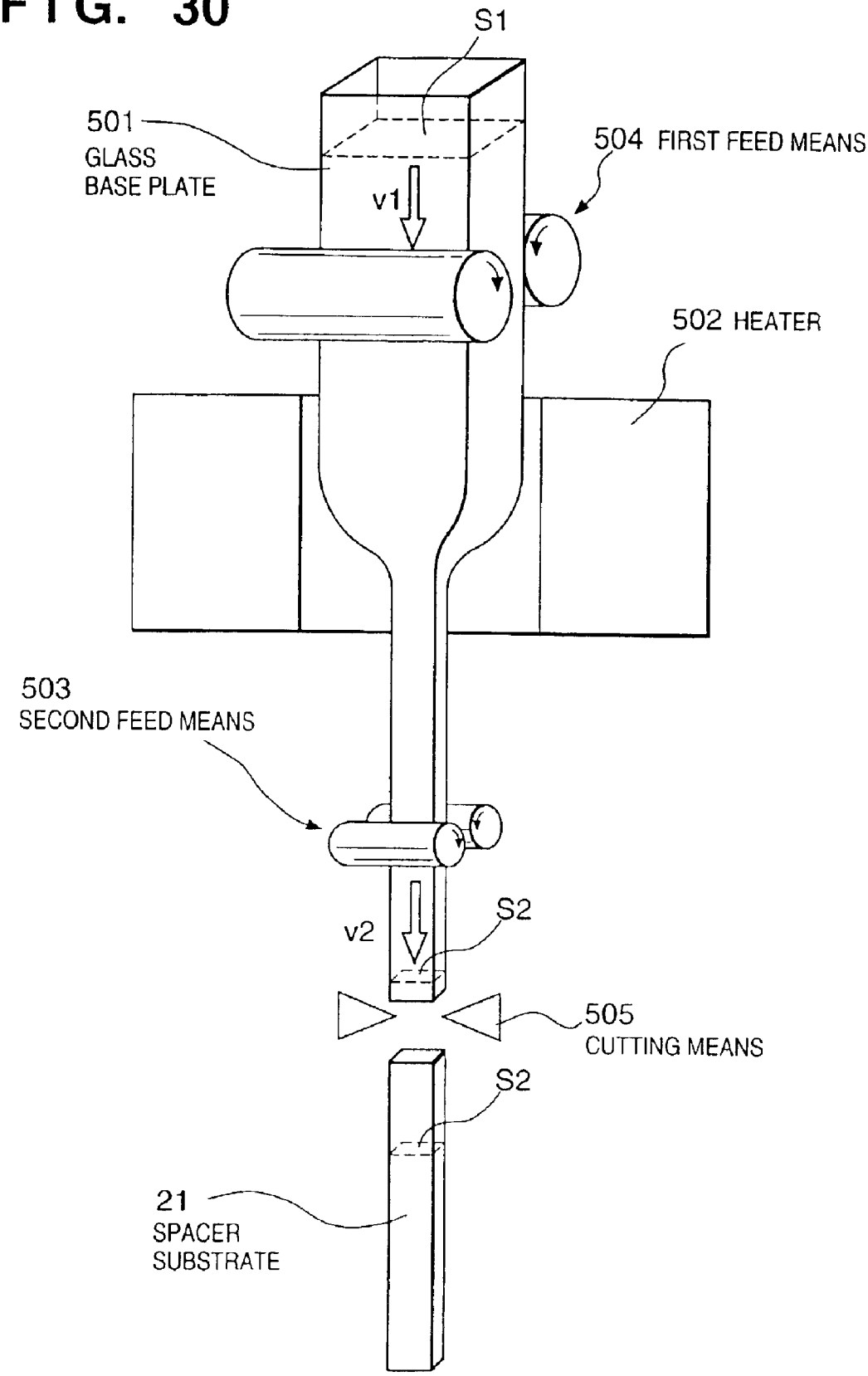
FIG. 30 is a schematic view showing an example of an apparatus for manufacturing the spacer substrate according to the present invention.

An example of the heating/stretching method will be explained using an apparatus shown in FIGS. 5 and 30 (from steps A to C). FIG. 30 shows the apparatus in FIG. 5 in more detail.

(Step A) A glass plate (preform) 501 is prepared. At this time, when S2 represents the final sectional area of the spacer substrate 21, and S1 represents the sectional area of the glass plate (preform) 501, S1 and S2 satisfy (S2/S1)<1.

The "section" means one obtained when the glass plate (preform) 501 or spacer substrate 21 is taken along a plane perpendicular to the direction component of a velocity v1 or v2 in FIG. 30.

(Step B) The two ends of the glass plate (preform) 501 prepared in step A are fixed, and part of the glass plate 501 in the longitudinal direction is heated by a heating means (heater) 502. One end portion is fed toward the heating means (heater) 502 by a first feed means (e.g., a roller) 504 at the velocity v1, and at the same time, the other end portion is fed by a second feed means (e.g., a stretching roller) 503 at the velocity v2 to draw the glass plate (preform) 501 from the heating means 502. The first feed means 504, heating means (heater) 502, and second feed means 503 stretch the glass plate (preform) 501 while heating it.

Note that the direction of the velocity v2 is substantially the same as the direction of the velocity v1. For this reason, the velocities v1 and v2 can be considered as speeds. These velocities v1 and v2 preferably satisfy (S2/S1)=(v1/v2). The value v2/v1 is preferably 10 to 10,000, and more preferably 100 to 10,000.

The heating temperature of the heating means (heater) 502 is preferably equal to or higher than the softening point of the glass plate (preform) 501 depending on the type and processing shape of glass, and is preferably 500 to 700° C.

By satisfying these conditions, a section having an edge at the preferable radius r of curvature can be obtained.

Preferable examples of the feed means 504 and 503 are rotary members such as rollers, and conveyors which convey the spacer substrate 21 or glass plate (preform) 501 while bringing a belt rotated by a plurality of rotating members into contact with the spacer substrate 21 or glass plate (preform) 501.

(Step C) The glass plate (preform) 501 stretched in step B is sufficiently cooled, and then cut into a desired length by a cutting means 505 to form the spacer substrate 21. The cooling temperature is simply room temperature.

By steps A to C, the spacer substrate 21 having an edge at the preferable radius r of curvature can be obtained.

The sectional shape of the glass plate (preform) 501 prepared in step A is preferably formed into the end portion shape (edge shape) shown in FIG. 3D. This facilitates forming by steps A to C the spacer substrate 21 similar in sectional shape to the glass plate (preform) 501 prepared in step A. By properly setting the ratio of the velocities v1 and v2, the spacer substrate 21 arbitrarily reduced in radius of curvature of the glass plate (preform) 501 can be obtained with high reproducibility.

The heating/stretching method need not directly process the spacer substrate 21 at a small radius of curvature demanded for it. In other words, since the spacer substrate 21 can be processed at a large radius of curvature, the edge of the spacer substrate 21 can easily attain the small radius of curvature with high precision.

Figure 5:
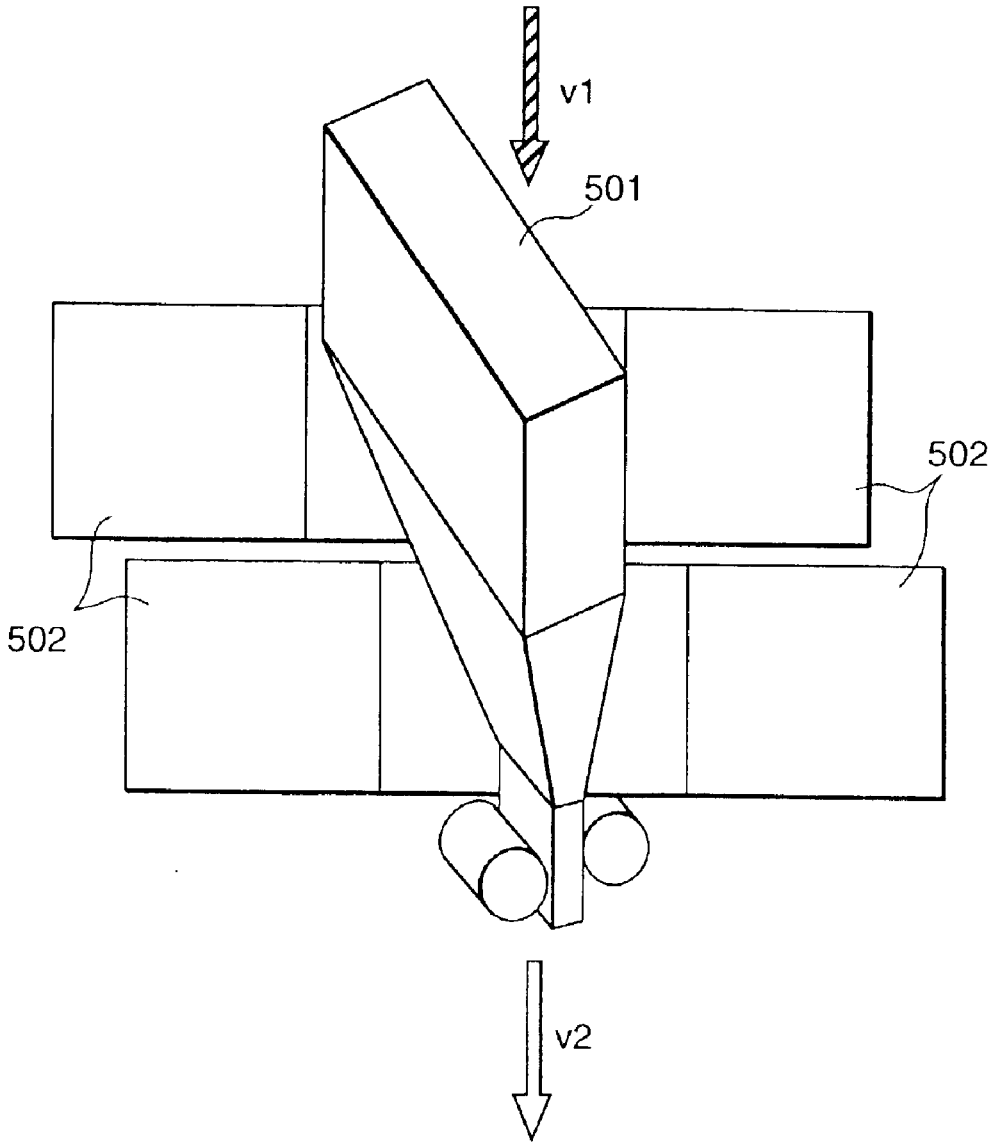
FIG. 5 is a view for explaining a heating/stretching apparatus for the spacer according to the embodiment.

In the heating/stretching method, as shown in FIG. 30 or 5, the feed means 504 and 503 are desirably laid out on the side surface (side surface in the longitudinal direction) of the spacer substrate 21 or glass plate (preform) 501 defined in FIG. 26. This is because the velocity can be stably controlled with high precision in feeding/stretching the spacer substrate 21 or glass plate (preform) 501 at the velocity v1 or v2. Further, as shown in FIG. 30 or 5, each of the feed means 504 and 503 is preferably made up of a pair of feed means for sandwiching the side surface (side surface in the longitudinal direction) of the spacer substrate 21 or glass plate (preform) 501. The feed means is preferably a simple means for conveying the spacer substrate 21 or glass plate (preform) 501 by rotation, but is not limited to this.

The low-resistance film (electrode) 25 is formed using the liquid phase formation method (e.g., dipping to be described later) on the spacer substrate 21 which is obtained by the above method and has an end surface shape defined in the equation (1). The edge of the spacer substrate 21 can be satisfactorily covered with the low-resistance film (electrode) 25.

Particularly when the spacer substrate 21 is formed using the heating/stretching method, the low-resistance film (electrode) 25 is desirably formed using the liquid phase formation method (e.g., dipping to be described later) after cutting the spacer substrate 21 into a desired length L in step C. This facilitates processing the spacer substrate 21 in forming the low-resistance film (electrode) 25 using the liquid phase formation method (e.g., dipping to be described later).

As a matter of course, the spacer preform 282 may be formed by steps A to C, and undergo the above-mentioned end surface processing to form the spacer substrate 21.

The method ② will be explained.

② When dipping is adopted from the liquid phase formation methods, a liquid in which a conductive material is dispersed or dissolved preferably has a viscosity of 10 cps or more so as to satisfactorily cover the edge of the spacer substrate with the low-resistance film (electrode) 25. The viscosity of the liquid is preferably 100 cps or more, and more preferably 1,000 cps or more.

This method can satisfactorily cover the edge of the spacer substrate 21 having an almost right angle with the low-resistance film (electrode) 25 without performing any spacer end surface processing.

Needless to say, a method of forming the low-resistance film (electrode) 25 by dipping on the spacer substrate 21 formed by the method ① is also preferable.

An example of dipping in the present invention will be explained with reference to FIGS. 2A to 2E. FIGS. 2A to 2E are views when viewed from the side surface of the spacer substrate.

Dipping in the present invention comprises step A (FIGS. 2A and 2B) of spreading and applying on a substrate 2001 a liquid 2002 in which a conductive material for forming the low-resistance film 25 is dispersed or dissolved, step B (FIGS. 2C and 2D) of bringing the end portion of the spacer substrate 21 into contact with the liquid 2002 spread on the substrate 2001 to dip the end portion in the liquid 2002, step C (FIG. 2E) of separating the spacer substrate 21 from the substrate 2001 coated with the liquid 2002 to transfer the liquid 2002, and step D of heating a liquid 25 transferred to the spacer substrate 21 to form the low-resistance film (electrode) 25.

In the present invention, the liquid in which a conductive material for forming the low-resistance film 25 is dispersed or dissolved will also be called a "coating solution".

This dipping method can easily simultaneously form the low-resistance film (electrode) 25 on the end surface and side surface of the spacer substrate 21.

The coating solution spread means of the dipping method includes a spread method using a bar coater or doctor blade, and a spread method using a spin coater.

A spread substrate 2001 need not always be flat, and a groove 292 for storing a coating solution 293 may be formed on the substrate 291, as shown in FIGS. 29A to 29E.

In the transfer step of separating the spacer substrate 21 after bringing it into contact with the coating solution, the spacer substrate 21 may be moved down to the spread surface, or the spread surface may be moved down to the spacer substrate 21.

The above-described method ① and/or ② allows satisfactorily covering the edge of the spacer substrate 21 with the low-resistance film (electrode) 25 when a simple, low-cost liquid phase formation method is adopted.

Figure 24:
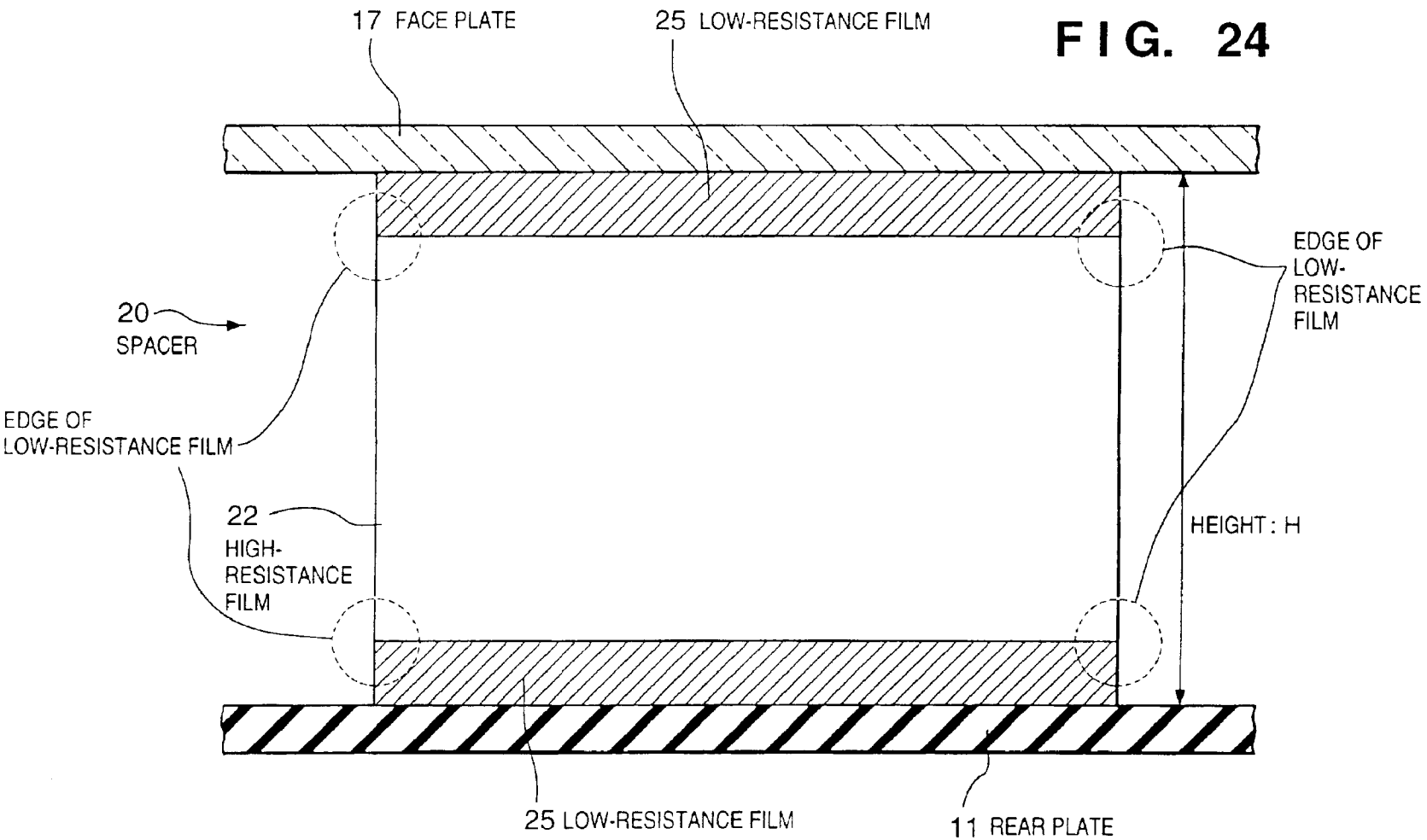
FIG. 24 is a schematic sectional view taken along the line A—A in FIG. 23.
Figure 32A:
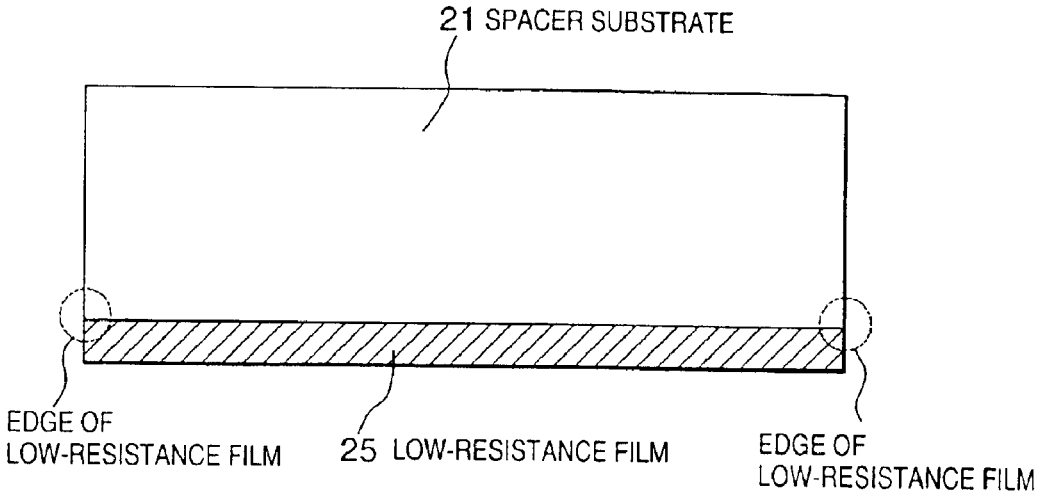
FIGS. 32A and 32B are schematic views, respectively, showing the processed state of the low-resistance film.

If the edge (corner) of the low-resistance film 25 formed on the side surface of the spacer substrate 21 is at a right angle or acute angle, as shown in FIGS. 24 or 32A, the electric field readily concentrates at this portion. In some cases, discharge may occur from this edge (corner).

Figure 32B:
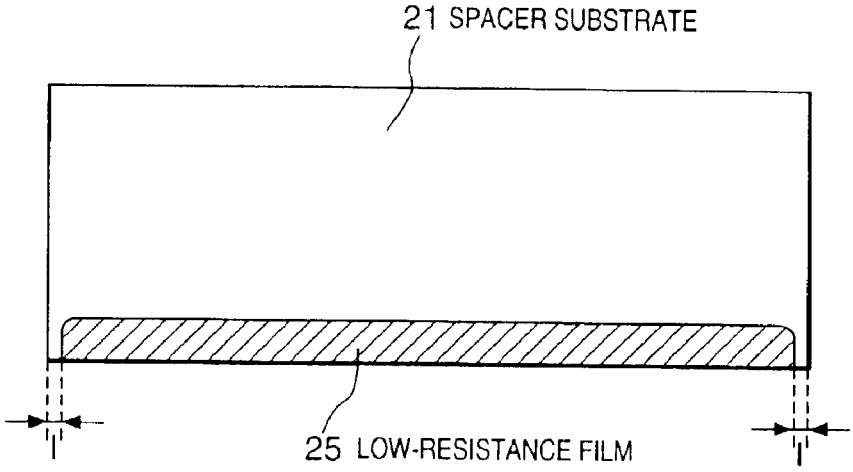

To suppress this, the edge (corner) is effectively processed to have the radius of curvature as shown in FIG. 32B after the edge is covered with the low-resistance film 25 by the method ① and/or ②.

Figure 33A:
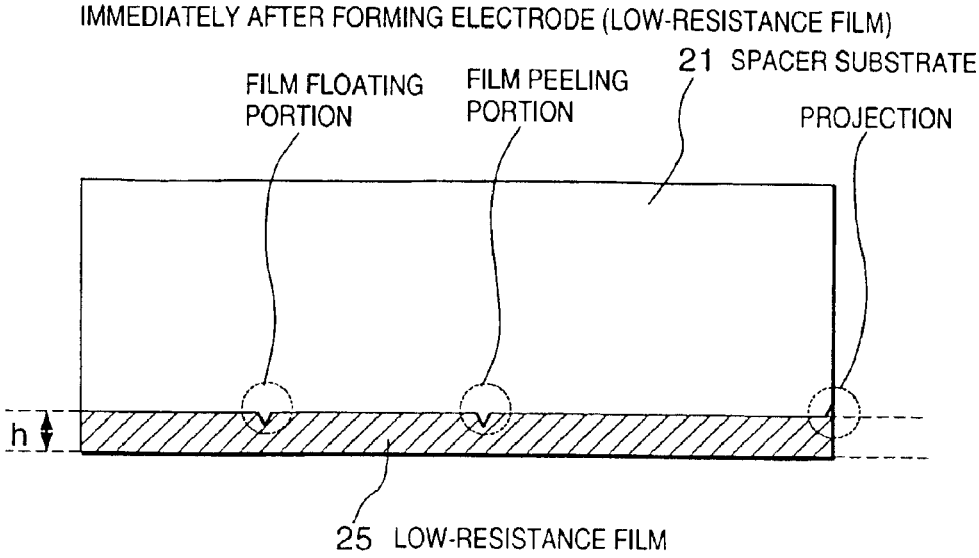
FIGS. 33A and 33B are schematic views, respectively, showing the processed state of the low-resistance film.

Further, part of the interface between the low-resistance film 25 and spacer substrate 21 may suffer film peeling, film floating, or projection, as shown in FIG. 33A, in conveying the spacer substrate covered with the low-resistance film 25 or depending on covering conditions. Also in this case, the electric field readily concentrates at such portion to cause not only discharge but also distortion on an equipotential surface.

Figure 33B:
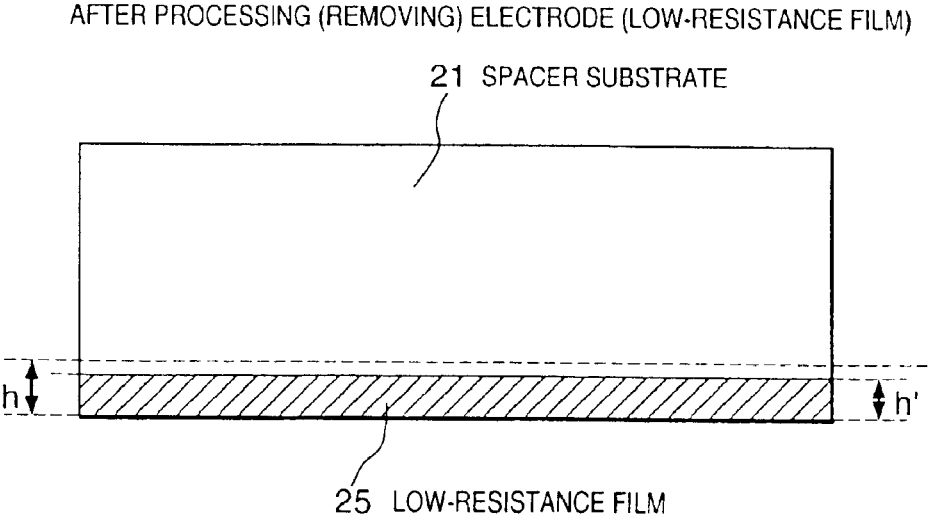

In this case, the low-resistance film 25 is effectively removed from h to h' in the direction of height (between the FP and RP), as shown in FIG. 33B. Note that h>h'.

Especially when no high-resistance film 22 is formed on the insulating spacer substrate, a triple point of vacuum, insulator (spacer substrate), and metal (low-resistance film) is formed at the interface to readily cause discharge arising from the shape of the low-resistance film 25. To prevent this, as described above, processing of the low-resistance film 25 is effective.

Examples of the method of processing (removing) the applied low-resistance film 25 are an etching process corresponding to the low-resistance film, removal using a laser beam repair system, photolithography, patterning using a lift-off process, and partial spread of the coating solution using a mask.

Since the spacer substrate 21 is made of glass or a ceramic, a low-cost spacer which can be easily cut and polished and has high assembly strength, and an image forming apparatus using the spacer can be manufactured. In particular, the face plate and rear plate are preferably made of the same material in terms of matching in thermal expansion coefficient.

Figure 23:
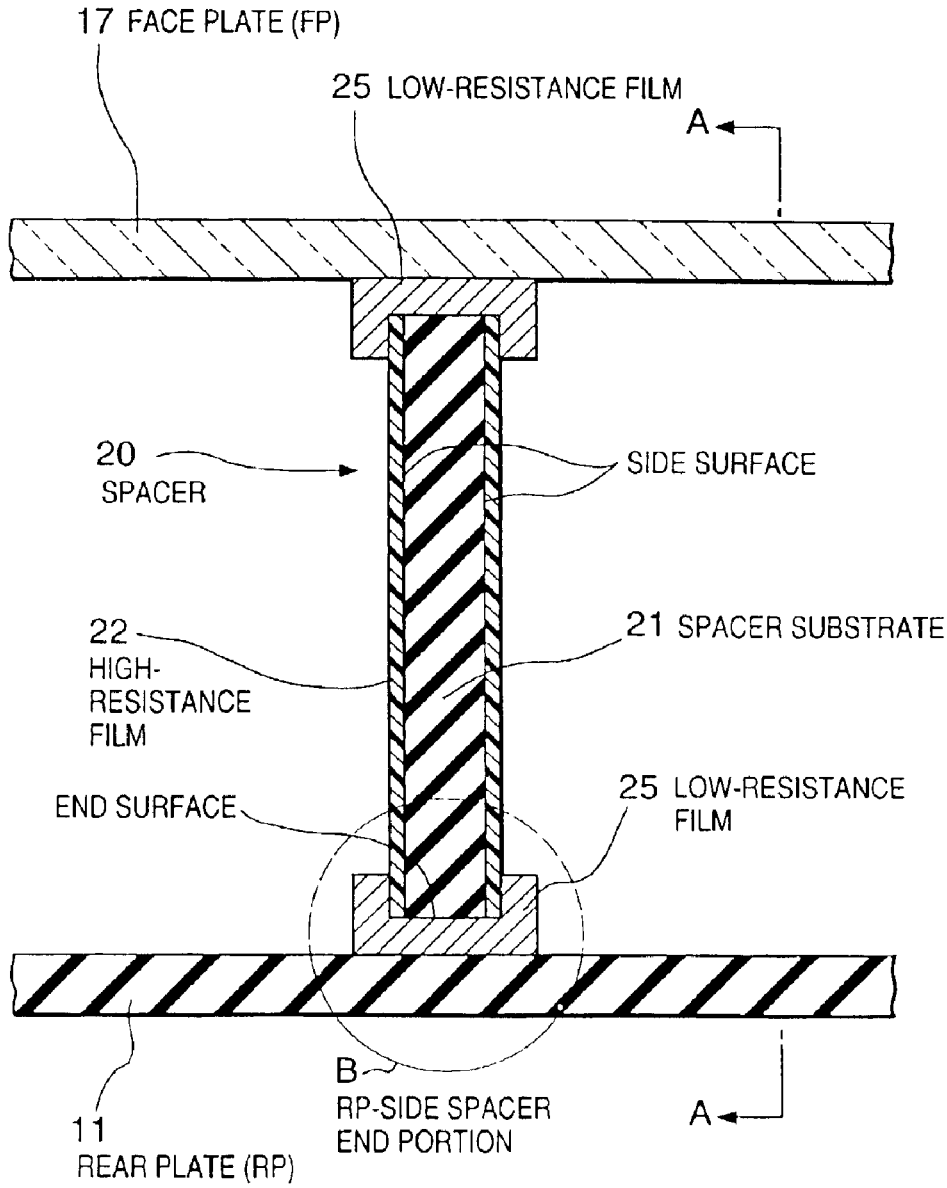
FIG. 23 is a schematic view showing an example of the low-resistance film formed on the spacer.

When the insulating spacer substrate 21 coated with the low-resistance film (electrode) 25 by the liquid phase formation method of the present invention is formed in a high-Va type image forming apparatus of applying a voltage of several kV to several ten kV between the rear plate (electron source) 11 and face plate 17, the high-resistance film 22 is preferably formed on the side surface of the spacer substrate 21, as shown in FIGS. 23 and 24. The high-resistance film 22 formed on the side surface of the insulating spacer substrate 21 can suppress charge-up of the spacer surface (side surface) to provide a high-quality image free from any shift of the emission spot.

FIGS. 23 and 24 show the high-resistance film 22 covering only the side surface of the spacer substrate 21. Instead, the high-resistance film 22 may cover all the surfaces (side surface and end surface) of the spacer substrate.

Further, the high-resistance film 22 need not cover the entire side surface of the spacer substrate 21. That is, the high-resistance film 22 covers only that portion of the side surface of the spacer substrate 21 exposed in the vacuum container which is not covered with the electrode (low-resistance film) 25. However, since the high-resistance film 22 must be electrically connected to the low-resistance film (electrode) 25, as described above, the low-resistance film (electrode) 25 and high-resistance film 22 preferably overlap each other to ensure the electrical connection.

FIGS. 23 and 24 show the low-resistance film (electrode) 25 covering the high-resistance film 22. To the contrary, the low-resistance film (electrode) 25 may cover the end portion of the spacer substrate 21, and the high-resistance film 22 may cover the side surface of the spacer substrate 21. This structure allows the high-resistance film 22 to cover the interface between the low-resistance film (electrode) 25 and spacer substrate, thereby suppressing discharge arising from the shape of the low-resistance film (electrode) 25 at the interface.

The high-resistance film 22 preferably has a sheet resistance of $10^5$ Ω/□ to $10^{12}$ Ω/□. The high-resistance film 22 having this sheet resistance can suppress charge-up, and current consumption and heat generation between the upper and lower substrates (FP and RP). On the other hand, to improve the electrical connection between the face plate and/or rear plate, and high-resistance film 22, the low-resistance film (electrode) 25 desirably has a sheet resistance of $10^7$ Ω/□ or less which is 1/10 or less the sheet resistance of the high-resistance film 22.

An electron source preferably used in the image forming apparatus of the present invention can use the above-described cold cathodes (MIM type, FE type, and surface-conduction emission type electron-emitting devices).

Of these cold cathodes, the surface-conduction emission type electron-emitting device is particularly suitable for a large-area flat panel display because of a simple device structure.

The image forming apparatus of the present invention includes, in addition to a display, for example, an apparatus of forming a latent image using an electron beam resist for a target (image forming member) irradiated with electrons emitted by an electron-emitting device.

(Arrangement and Manufacturing Method of Display Panel 101)

The arrangement and manufacturing method of an image display apparatus (display panel) 101 applied to the present invention will be exemplified.

Figure 7:
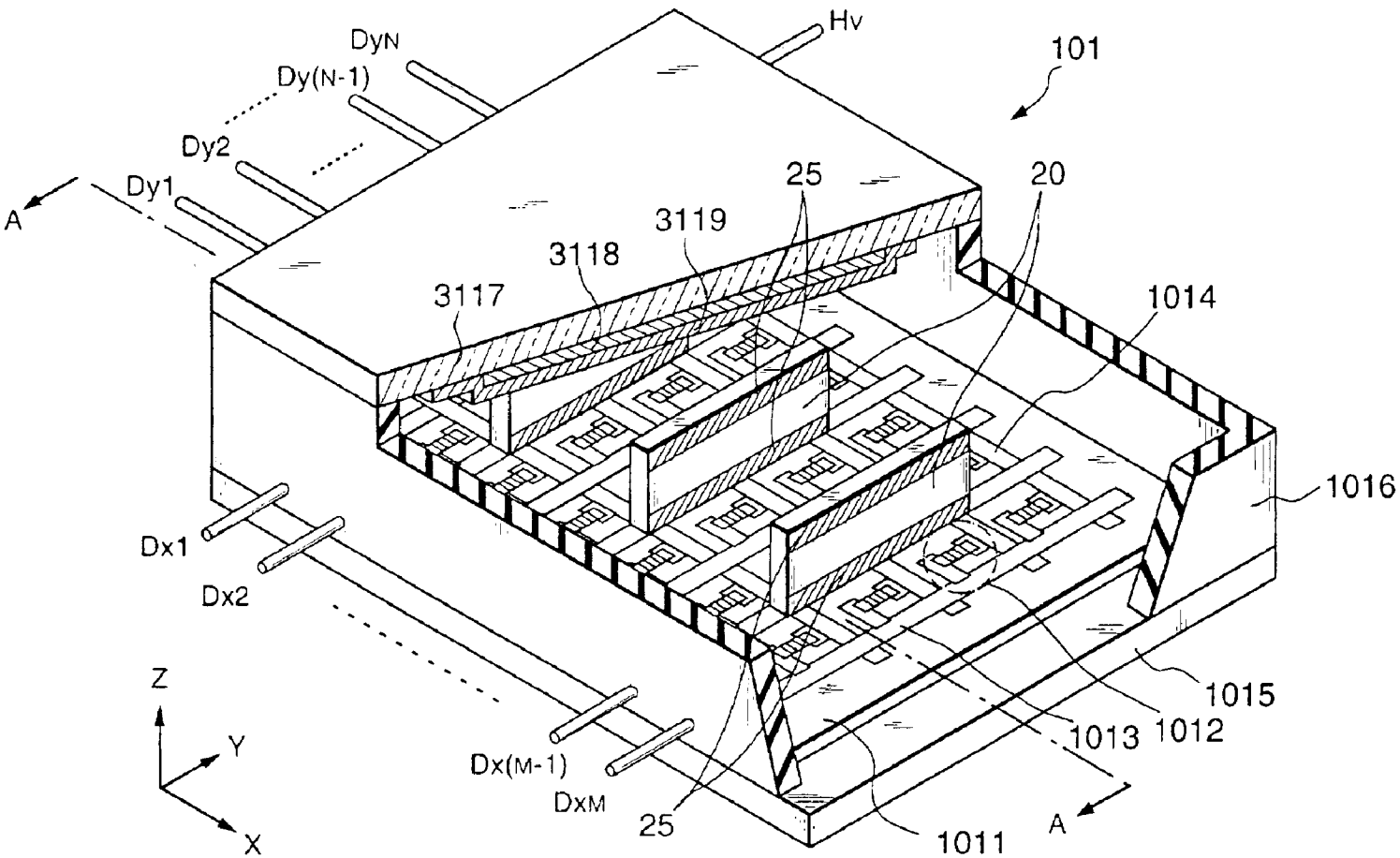
FIG. 7 is a partially cutaway perspective view showing the display panel of an image display apparatus according to the embodiment of the present invention.

FIG. 7 is a partially cutaway perspective view of the outer appearance of the display panel 101 used in the embodiment showing the internal structure of the display panel 101.

In FIG. 7, reference numeral 1015 denotes a rear plate; 1016, a side wall; and 1017, a face plate. These parts 1015 to 1017 constitute an airtight container for maintaining the inside of the display panel 101 vacuum. To construct the airtight container, it is necessary to seal-connect the respective parts to obtain sufficient strength and maintain airtight condition. For example, frit glass is applied to joint portions and sintered in air or nitrogen atmosphere at 400 to 500° C. to seal-connect the parts. The interior of the airtight container is kept at a vacuum of about $10^{-6}$ Torr. To prevent damage to the airtight container by the atmospheric pressure or sudden shock, a spacer 20 of the present invention is employed as an atmospheric pressure resistance structure.

The rear plate 1015 has a substrate 1011 fixed thereon, on which N×M cold cathodes 1012 are formed. Note that N and M are positive integers equal to 2 or more, and properly set in accordance with a desired number of display pixels. For example, in a display apparatus for high-resolution television display, N=3,000 or more, M=1,000 or more are desirably set. The N×M cold cathodes 1012 are arranged in a simple matrix with M row-direction wirings 1013 and N column-direction wirings 1014. The portion constituted by the substrate 1011 to column wirings 1014 will be referred to as a multi electron source. As long as the multi electron source of this embodiment is constituted by arranging cold cathodes in a simple matrix, the material, shape, and manufacturing method of the cold cathode materials are not particularly limited. Hence, cold cathodes such as surface-conduction emission type electron-emitting devices, FE type electron-emitting devices, and MIM type electron-emitting devices can be used.

The structure of the multi electron source constituted by arranging surface-conduction emission type electron-emitting devices as cold cathodes in a simple matrix on a substrate will be described.

Figure 8:
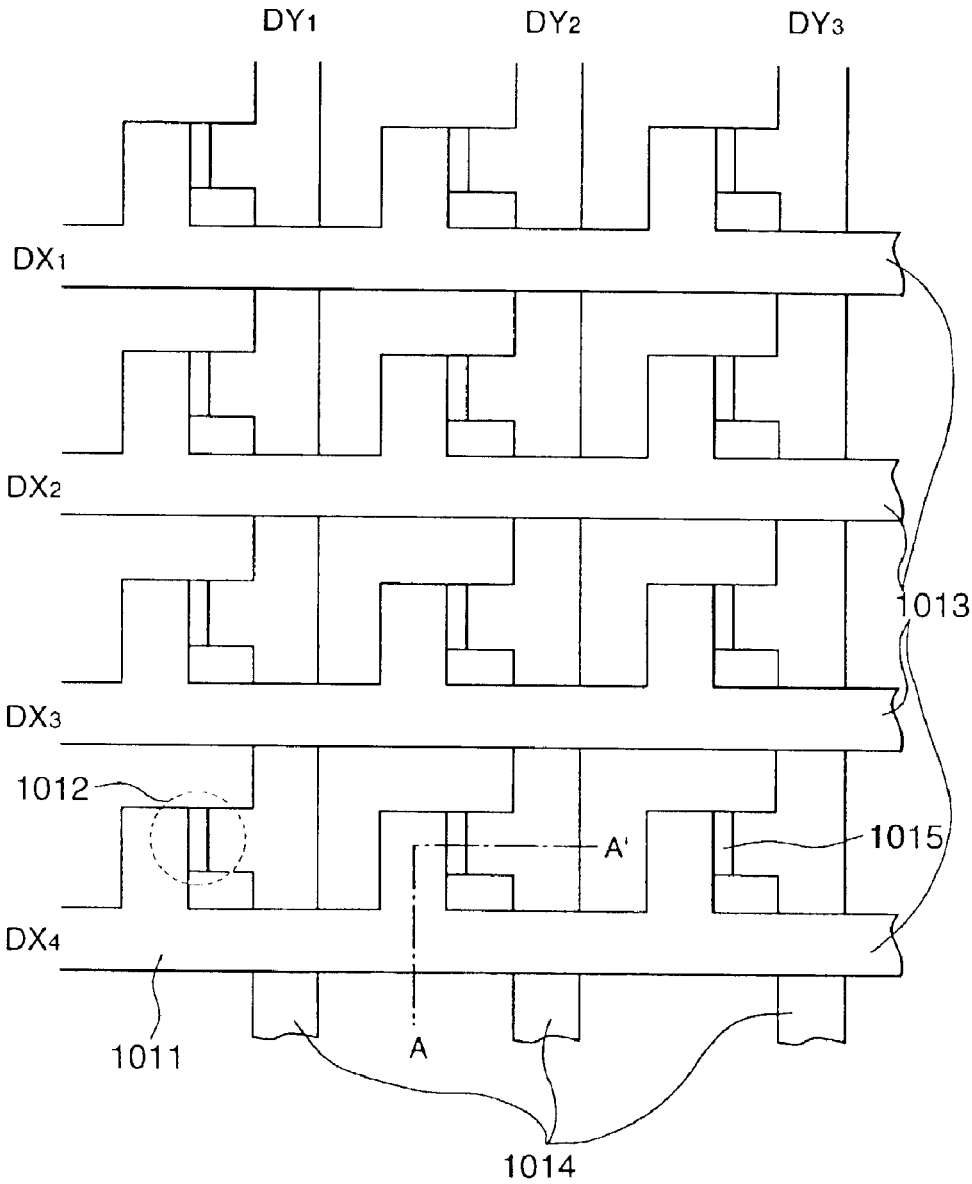
FIG. 8 is a plan view showing the substrate of a multi electron source used in the embodiment.

FIG. 8 is a plan view showing a multi electron source used in the display panel 101 in FIG. 7. Surface-conduction emission type electron-emitting devices like the one shown in FIG. 12 are laid out on the substrate 1011, and wired in a simple matrix by row- and column-direction wiring electrodes 1003 and 1004. An insulating layer (not shown) is formed at the intersection of the row- and column-direction wiring electrodes 1003 and 1004 to maintain electrical insulation.

Figure 9:
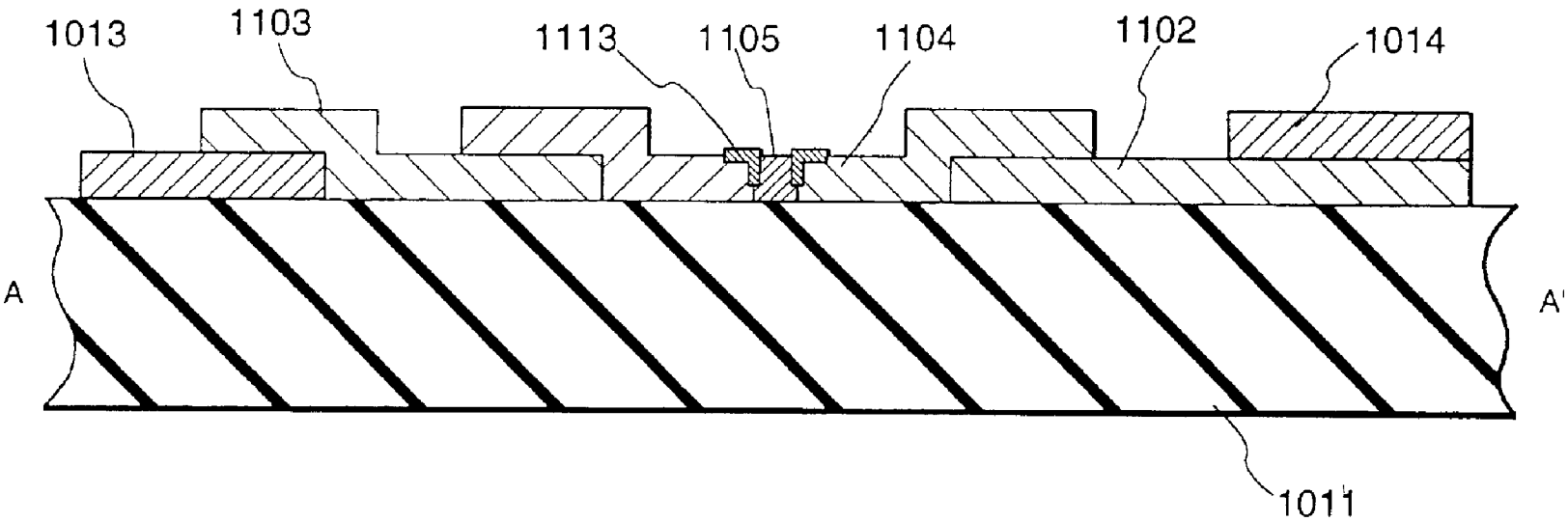
FIG. 9 is a partial sectional view showing the substrate of the multi electron source in FIG. 8.

FIG. 9 is a sectional view taken along the line A–A' in FIG. 8. The multi electron source having this structure is manufactured as follows. The row- and column-direction wiring electrodes 1013 and 1014, insulating layer (not shown), and device electrodes 1102 and 1103 and conductive thin films 1104 of surface-conduction emission type electron emitting devices are formed on the substrate 1011 in advance. Then, a voltage is applied to the respective devices via the row- and column-direction wiring electrodes 1013 and 1014 to perform forming processing (to be described later) and activation processing (to be described later).

In this embodiment, the substrate 1011 of the multi electron source is fixed to the rear plate 1015 of the airtight container. If, however, the substrate 1011 of the multi electron source has sufficient strength, the substrate 1011 of the multi electron source may also be used as the rear plate of the airtight container.

Figure 10A:
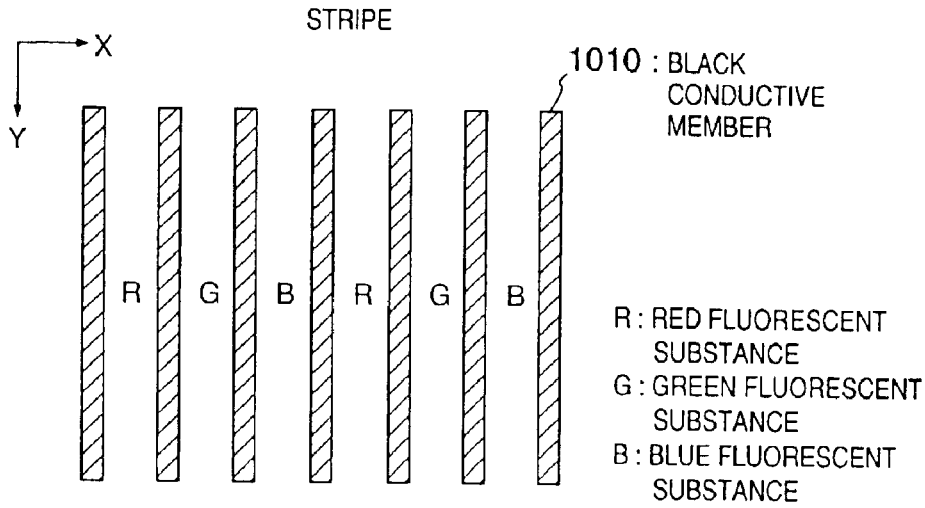
FIGS. 10A and 10B are plan views, respectively, showing examples of the layout of fluorescent substances on the face plate of the display panel according to the embodiment.

A fluorescent film 1018 is formed on the lower surface of the face plate 1017. As this embodiment is a color display apparatus, the fluorescent film 1018 is coated with red, green, and blue fluorescent substances, i.e., three primary color fluorescent substances used in the CRT field. As shown in FIG. 10A, the respective color fluorescent substances are formed into stripes, and black conductive members 1010 are provided between the stripes of the fluorescent substances. The purpose of providing the black conductive members 1010 is to prevent display color misregistration even if the electron irradiation position is shifted to some extent, to prevent degradation of display contrast by shutting off reflection of external light, to prevent the charge-up of the fluorescent film by electrons, and the like. As the material for the black conductive members 1010, graphite is used as a main component, but other materials may be used so long as the above purpose is attained.

Figure 10B:
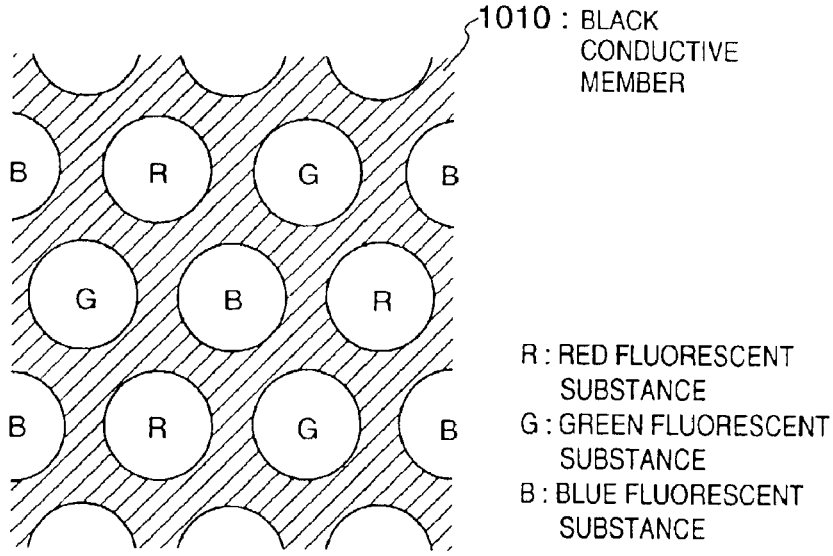

Further, the three primary colors of the fluorescent film is not limited to the stripes as shown in FIG. 10A. For example, delta arrangement as shown in FIG. 10B or any other arrangement may be employed. Note that when a monochrome display panel 101 is formed, a single-color fluorescent substance may be applied to the fluorescent film 1018, and the black conductive member 1010 may be omitted.

Furthermore, a metal back 1019, which is well-known in the CRT field, is provided on the fluorescent film 1018 on the rear plate side. The purpose of providing the metal back 1019 is to improve the light-utilization ratio by mirror-reflecting part of the light emitted by the fluorescent film 1018, to protect the fluorescent film 1018 from collision with negative ions, to be used as an electrode for applying an electron-beam accelerating voltage, to be used as a conductive path for electrons which excited the fluorescent film 1018, and the like. The metal back 1019 is formed by forming the fluorescent film 1018 on the face plate substrate 1017, smoothing the front surface of the fluorescent film, and depositing aluminum (Al) thereon by vacuum deposition. Note that when a fluorescent material for a low voltage is used for the fluorescent film 1018, the metal back 1019 is not used.

Furthermore, for application of an accelerating voltage or improvement of the conductivity of the fluorescent film, transparent electrodes made of, e.g., ITO may be provided between the face plate substrate 1017 and the fluorescent film 1018, although such electrodes are not used in this embodiment.

Row wiring terminals Dx1 to DxM, column wiring terminals Dy1 to DyN, and Hv serve as electric connection terminals for an airtight structure provided to electrically connect the display panel 101 to the above-described circuit. The row wring terminals Dx1 to DxM are electrically connected to the row-direction wirings 1013 of the multi electron source; the column wiring terminals Dy1 to DyN, to the column-direction wirings 1014 of the multi electron source; and Hv, to the metal back 1019 of the face plate 1017.

To evacuate the airtight container, after forming the airtight container, an exhaust pipe and vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after the sealing. The getter film is a film formed by heating and evaporating a getter material mainly consisting of, e.g., Ba, by a heater or RF heating. The suction effect of the getter film maintains a vacuum of $1\times10^{-5}$ or $1\times10^{-7}$ Torr in the container.

Figure 11:
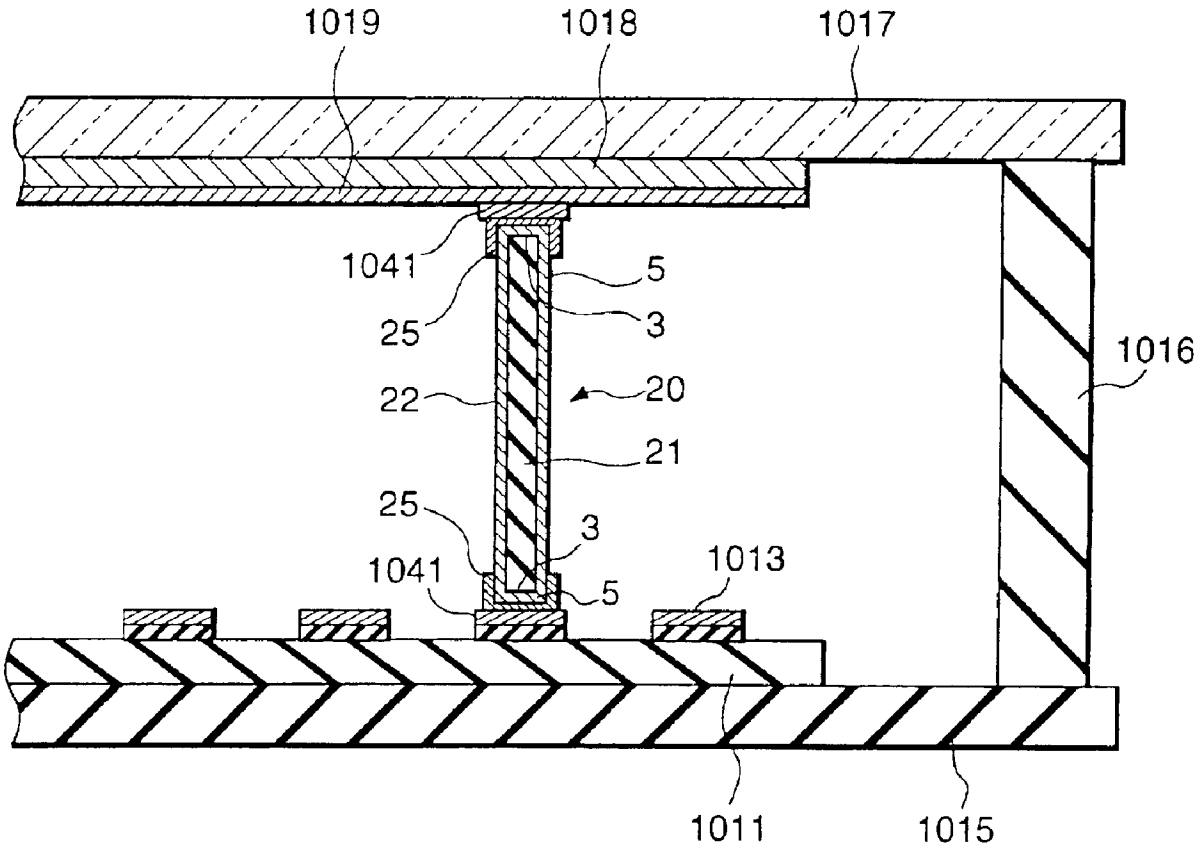
FIG. 11 is a sectional view showing the display panel taken along the line A–A' in FIG. 7.

FIG. 11 is a schematic sectional view taken along the line A–A' in FIG. 7. The reference numerals as in FIG. 7 denote the same parts in FIG. 11.

In this embodiment, the spacer 20 is a member obtained by forming the high-resistance film 22 on the surface of the insulating spacer substrate 21 to suppress charge-up, and forming the low-resistance films (electrodes) 25 on side surface 5 and abutment surfaces (end surfaces) 3 of the spacer substrate 21 which face the inner surface (the metal back 1019 and the like) of the face plate 1017 and the surface (row- or column-direction wiring 1013 or 1014) of the substrate 1011. A necessary number of spacers 20 for achieving the above object are fixed on the inner surface of the face plate 1017 and the surface of the substrate 1011 at necessary intervals with bonding members 1041. The high-resistance film 22 is formed at least a surface of the spacer 21 exposed in vacuum in the airtight container. The high-resistance film 22 are electrically connected to the inner surface (metal back 1019 and the like) of the face plate 1017 and the surface (row- or column-direction wiring 1013 or 1014) of the substrate 1011 via the low-resistance films (electrodes) 25 and bonding members 1041. In this case, the spacer 20 is connected to the inner surface (metal back 1019 and the like) of the face plate and the surface (row- or column-direction wiring 1013 or 1014) of the substrate 1011 with the bonding members 1041. However, the bonding members can be omitted.

In this embodiment, the spacer 20 is flat, is parallel to the row-direction wiring 1013, and is electrically connected to the row-direction wiring 1013. The spacer 20 must have insulating properties enough to stand a high voltage applied between the row- and column-direction wirings 1013 and 1014 on the substrate 1011 and the metal back 1019 on the inner surface of the face plate 1017, and have conductivity enough to suppress charge-up of the surface of the spacer 20.

In this embodiment, the spacer substrate 21 for forming the spacer 20 is made of, e.g., silica glass, glass containing a small amount of impurity such as Na, soda-lime glass, or a ceramic of alumina or the like. Note that the spacer substrate 21 preferably has a thermal expansion coefficient near that of a member for forming the airtight container and the substrate 1011.

A current obtained by dividing an accelerating voltage Va applied to the face plate 1017 (metal back 1019 and the like) on the high potential side by a resistance Rs of the high-resistance film 22 flows through the high-resistance film 22 of the spacer 20. The resistance Rs of the spacer 20 is set within a desired range for suppressing charge-up and power consumption. The sheet resistance is preferably set to $10^{12}$ Ω/□ or less to suppress charge-up. To obtain a sufficient charge-up suppression effect, the sheet resistance is preferably set to $10^{11}$ Ω/□ or less. The lower limit of this sheet resistance depends on the shape of the spacer 20 and a voltage applied between the spacers 20, and is preferably set to $10^{5}$ Ω/□ or more.

The high-resistance film 22 formed on the spacer substrate 21 desirably has a thickness t falling within the range of 10 nm to 1 μm. In general, a thin film 10 nm or less in thickness is generally formed into an island, and exhibits unstable resistance and low reproducibility, which changes depending on the surface energy of the material for the spacer substrate 21, the adhesion properties with the spacer substrate 21, and the substrate temperature. To the contrary, a film 1 μm or more in thickness t readily peels off due to high film stress, and is poor in productivity due to a long film formation time.

Hence, the thickness t is desirably 50 to 500 nm. The sheet resistance is given by ρ/t where the resistivity ρ of the high-resistance film 22 is preferably 0.1 Ω·cm to $10^{8}$ Ω·cm in consideration of the preferable ranges of the sheet resistance and thickness t. To realize more preferable ranges of the sheet resistance and thickness t, ρ is set to $10^{2}$ to $10^{6}$ Ω·cm.

As described above, a current flows through the high-resistance film 22, or the whole display panel 101 generates heat during operation to raise the temperature of the spacer 20. If the resistance temperature coefficient of the high-resistance film 22 is a large negative value, the resistance decreases upon temperature rise. As a result, the current flowing in the spacer 20 increases to further raise the temperature, and keeps increasing beyond the limit of the power source. Empirically, the resistance temperature coefficient which causes such current runaway is a negative value whose absolute value is 1% or more. Therefore, the resistance temperature coefficient of the high-resistance film 22 is desirably less than −1%.

Examples of the material for the high-resistance film 22 capable of suppressing charge-up are metal oxides. Of the metal oxides, chromium oxide, nickel oxide, and copper oxide are preferable because they have relatively low secondary electron-emitting efficiency, and are not easily charged even if electrons emitted by the electron-emitting device 1012 collide against the spacer 20. In addition to the metal oxides, carbon is preferable because it has low secondary electron-emitting efficiency. Since amorphous carbon has a high resistance, the resistance of the spacer 20 can be easily controlled to a desired value.

Another material for the high-resistance film 22 is a nitride of aluminum and a transition metal alloy because the composition of the transition metal can be adjusted to control the resistance in a wide resistance range from a good conductor to insulator. The nitride is a stable material which hardly changes in resistance during the process of manufacturing a display apparatus (to be described later). In addition, the nitride has a resistance temperature coefficient less than −1% and is suitable for practice use. Examples of the transition metal element are Ti, Cr, and Ta.

The alloy nitride film is formed on the insulating member by a thin film formation means such as sputtering, reactive sputtering in a nitrogen atmosphere, electron beam deposition, ion plating, or ion-assisted deposition. The metal oxide film can also be formed following the same thin film formation method using oxygen gas instead of nitrogen gas. The metal oxide film can also be formed by CVD or alkoxide coating. The carbon film is formed by deposition, sputtering, CVD, or plasma CVD. Particularly the amorphous carbon film is formed in a film formation atmosphere containing hydrogen, or using a hydrocarbon gas as a film formation gas.

The low-resistance films (electrodes) 25 electrically connect the high-resistance film 22 to the high-potential-side face plate 1017 (metal back 1019 and the like) and low-potential-side substrate 1011 (wirings 1013 and 1014 and the like).

The low-resistance films (electrodes) 25 can be equipped with a plurality of following functions.

① The low-resistance films (electrodes) 25 electrically connect the high-resistance film 22 to the face plate 1017 and substrate 1011.

As described above, the high-resistance film 22 is formed to suppress charge-up on the surface of the spacer 20. When the high-resistance film 22 is connected to the face plate 1017 (metal back 1019 and the like) and substrate 1011 (wirings 1013 and 1014 and the like) directly or through the bonding members 1041, a large contact resistance is produced at the interface of the connected portion, failing to quickly remove charges produced on the surface of the spacer 20. To prevent this, the low-resistance films (electrodes) 25 are formed on abutment surfaces 3 and side surface portions 5 of the spacer 20 in contact with the face plate 1017, substrate 1011, and bonding members 1041.

② The low-resistance films (electrodes) 25 make the potential distribution of the high-resistance film 22 uniform.

Electrons emitted by the electron-emitting devices 1012 follow orbits formed in accordance with the potential distribution formed between the face plate 1017 and substrate 1011. To prevent disturbance of the electron orbits near the spacer 20, the entire potential distribution of the spacer 20 must be controlled. When the high-resistance film 22 is connected to the face plate 1017 (metal back 1019 and the like) and substrate 1011 (wirings 1013 and 1014 and the like) directly or through the bonding members 1041, the connected state varies owing to the contact resistance at the interface of the connected portion, and the potential distribution of the high-resistance film 22 may deviate from a desired value. To prevent this, the low-resistance films (electrodes) 25 are formed on the spacer end portions (end surfaces 3 and side surface 5) of the spacer 20 in contact with the face plate 1017 and substrate 1011. By applying a desired potential to the low-resistance films (electrodes) 25, the potential of the entire high-resistance film 22 can be controlled.

③ The low-resistance films (electrodes) 25 control the orbits of emitted electrons.

Electrons emitted by the electron-emitting devices 1012 follow orbits formed in accordance with the potential distribution formed between the face plate 1017 and substrate 1011. Electrons emitted by electron-emitting devices 1012 near the spacer 20 may be constrained (changed in wirings and device positions) owing to the presence of the spacer 20.

In this case, to form an image free from any distortion and fluctuation, the orbits of emitted electrons must be controlled to make the electrons irradiate desired positions on the face plate 1017. By forming the low-resistance films (electrodes) 25 on the side surface portions 5 in contact with the face plate 1017 and substrate 1011, the potential distribution near the spacer 20 can be given desired characteristics to control the orbits of emitted electrons.

An example of the material for the low-resistance films (electrodes) 25 is one sufficiently lower in resistance than the high-resistance film 22. Examples of such material is metals such as Ni, Cr, Au, Mo, W, Pt, Ti, Al, Cu, and Pd, alloys thereof, printed conductors made of metals such as Pd, Ag, Au, $RuO_2$, and Ag—PbO or metal oxides and glass, a conductive fine particle-dispersed film in which conductive fine particles of $SnO_2$ doped with Sb or the like are dispersed in a binder prepared by substituting the terminal of silica or silicon oxide by alkyl, alkoxy, fluorine, or the like, or transparent conductors such as $In_2O_3$—$SnO_2$, and semiconductor materials such as polysilicon.

The bonding members 1041 must be conductive so as to electrically connect the spacer 20 to the row-direction wiring 1013 and metal back 1019. Examples of the bonding members 1041 are a conductive adhesive, and frit glass containing metal particles or conductive filler.

In an image display apparatus using the above-described display panel 101, a voltage is applied to the electron-emitting devices 1012 via the terminals Dx1 to DxM and Dy1 to DyN to emit electrons from the electron-emitting devices 1012. At the same time, a high voltage of several hundred V to several kV is applied to the metal back 1019 via the terminal Hv to accelerate the emitted electrons toward the face plate 1017 and collide them against the inner surface of the face plate 1017. Then, the fluorescent substances of respective colors of the fluorescent film 1018 are excited to emit light, thereby displaying an image.

In general, the application voltage to the surface-conduction emission type electron-emitting device 1012 of this embodiment serving as an electron-emitting device (cold cathode) is about 12 V to 16 V, a distance d between the metal back 1019 and cold cathode 1012 is about 0.1 mm to 8 mm, and the voltage between the metal back 1019 and cold cathode 1012 is about 0.1 kV to 10 kV.

The basic arrangement and manufacturing method of the display panel 101 according to this embodiment, and the image display apparatus have been described.

A method of manufacturing the multi electron source used in the display panel 101 of this embodiment will be described below. The multi electron source used in the image display apparatus of this embodiment is not particularly limited in the material, shape, and manufacturing method of the cold cathode so long as the electron source is constituted by arranging cold cathodes in a simple matrix. Thus, the multi electron source can adopt various cold cathodes such as a surface-conduction emission type electron-emitting device, FE type device, and MIM type device. Under circumstances where inexpensive display apparatuses having large display areas are required, the surface-conduction emission type electron-emitting device is particularly preferable among these cold cathodes. More specifically, the electron-emitting characteristic of the FE type device is greatly influenced by the relative positions and shapes of the emitter cone and gate electrode, and hence a high-precision manufacturing technique is required to manufacture this device. This poses a disadvantageous factor in attaining a large display area and a low manufacturing cost. According to the MIM type device, the thicknesses of the insulating layer and upper electrode must be decreased and made uniform. This also poses a disadvantageous factor in attaining a large display area and a low manufacturing cost. In contrast to this, the surface-conduction emission type electron-emitting device can be manufactured by a relatively simple manufacturing method, and can easily realize a large display area and a low manufacturing cost.

The present inventors have also found that among the surface-conduction emission type electron-emitting devices, an electron source having an electron-emitting portion or its peripheral portion made of a fine particle film is excellent in electron-emitting characteristic and can be easily manufactured. Such device can therefore be most suitably used in the multi electron source of a high-brightness, large-screen image display apparatus. For this reason, the display panel 101 of this embodiment adopts the surface-conduction emission type electron-emitting device having an electron-emitting portion or its peripheral portion made of a fine particle film. The basic structure, manufacturing method, and characteristics of the preferred surface-conduction emission type electron-emitting device will be first described, and then the structure of the multi electron source having many devices arranged in a simple matrix will be described.

(Preferred Structure and Manufacturing Method of Surface-Conduction Emission Type Electron-Emitting Device)

Typical examples of the surface-conduction emission type electron-emitting device having an electron-emitting portion or its peripheral portion made of a fine particle film include two types of devices, namely flat and step type devices.

(Flat Surface-Conduction Emission Type Electron-Emitting Device)

First, the structure and manufacturing method of a flat surface-conduction emission type electron-emitting device according to this embodiment will be described.

Figure 12A:
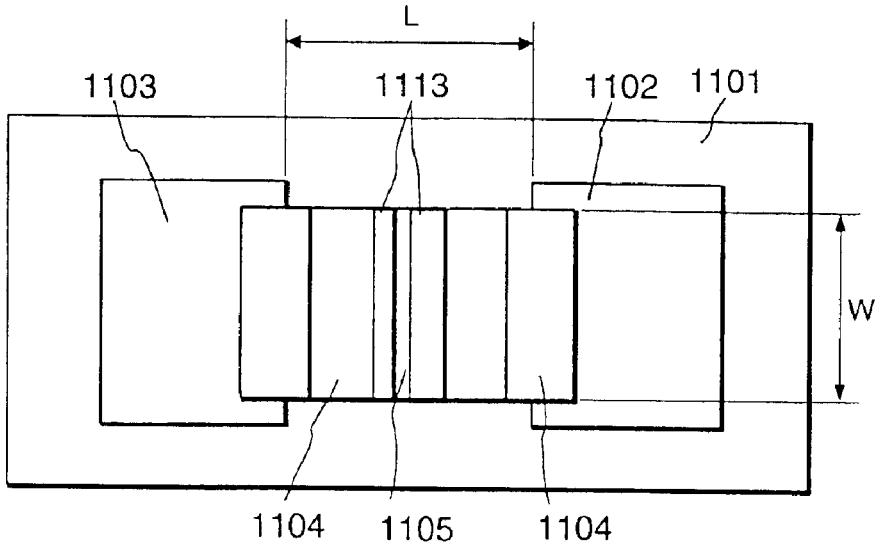
FIGS. 12A and 12B are a plan view and a sectional view, respectively, showing a flat surface-conduction emission type electron-emitting device used in the embodiment.
Figure 12B:
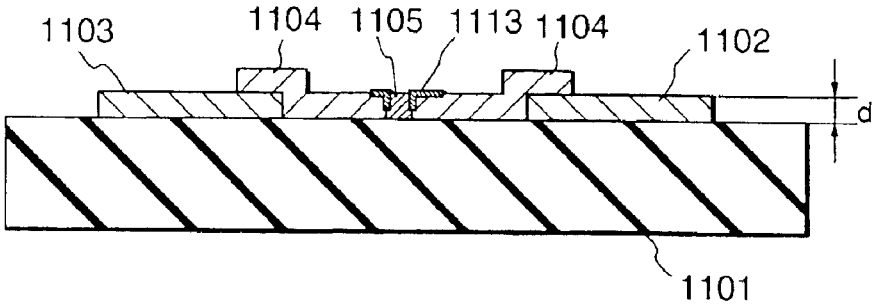

FIGS. 12A and 12B are a plan view and sectional view for explaining the structure of the flat surface-conduction emission type electron-emitting device. In FIGS. 12A and 12B, reference numeral 1101 denotes a substrate; 1102 and 1103, device electrodes; 1104, a conductive thin film; 1105, an electron-emitting portion formed by forming processing; and 1113, a thin film formed by activation processing.

Examples of the substrate 1101 are various glass substrates of quartz glass, soda-lime glass, and the like, various ceramic substrates of alumina and the like, and these substrates with insulating layers formed thereon.

The device electrodes 1102 and 1103 facing each other in parallel with the substrate 1101 are made of a conductive material. Examples of this conductive material are metals such as Ni, Cr, Au, Mo, W, Pt, Ti, Cu, Pd and Ag, alloys of these metals, metal oxides such as $In_2O_3$—$SnO_2$, and semiconductor materials such as polysilicon. These electrodes can be easily formed by a combination of a film formation technique such as vacuum evaporation and a patterning technique such as photolithography or etching. However, these electrodes can also be formed by any other method (e.g., printing technique).

The shape of the electrodes 1102 and 1103 is appropriately designed in accordance with the application object of the electron-emitting device. Generally, an interval L between the electrodes is designed by selecting an appropriate value from the range of several hundred Å to several hundred $\mu$m, and more preferably from the range of several $\mu$m to several ten $\mu$m. As for electrode thickness d, an appropriate value is selected from the range of several hundred Å to several $\mu$m.

The conductive thin film 1104 is made of a fine particle film. The "fine particle film" is a film containing a lot of fine particles (including masses of particles) as a constituent member. In microscopic view, normally individual particles exist in the film at predetermined intervals, adjacent to each other, or overlap each other.

One particle of the fine particle film has a diameter falling within the range of several Å to several thousand Å and preferably the range of 10 Å to 200 Å. The thickness of the fine particle film is appropriately set in consideration of the following conditions: condition necessary for electrically connecting the device electrode 1102 or 1103, condition for forming processing (to be described later), condition for setting the electrical resistance of the fine particle film itself to an appropriate value (to be described later), and the like. More specifically, the thickness of the fine particle film is set from the range of several Å to several thousand Å, more preferably the range of 10 Å to 500 Å.

Examples of the material for forming the fine particle film are metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN and HfN, semiconductors such as Si and Ge, and carbons. The material is appropriately selected from them.

As described above, the conductive thin film 1104 is made of a fine particle film, and its sheet resistance is set to reside within the range of $10^3$ to $10^7$ Ω/□.

As the conductive thin film 1104 is preferably electrically connected to the device electrodes 1102 and 1103, they partially overlap each other. In FIGS. 12A and 12B, the respective parts are stacked in the order of the substrate, device electrodes, and conductive thin film from the bottom, but may be stacked in the order of the substrate, conductive thin film, and device electrodes from the bottom.

The electron-emitting portion 1105 is a fissure formed at part of the conductive thin film 1104. The electron-emitting portion 1105 has a resistance higher than peripheral conductive thin film. The fissure is formed by performing forming processing (to be described later) for the conductive thin film 1104. Particles several Å to several hundred Å in diameter may be set in the fissure. Since it is difficult to exactly illustrate the actual position and shape of the electron-emitting portion, FIGS. 12A and 12B schematically shows the fissure.

The thin film 1113 of carbon or a carbon compound covers the electron-emitting portion 1115 and its peripheral portion. The thin film 1113 is formed by activation processing (to be described later) after forming processing.

The thin film 1113 is preferably graphite monocrystalline, graphite polycrystalline, amorphous carbon, or mixture thereof, and the thickness is 500 Å or less, and more preferably 300 Å or less.

As it is difficult to exactly illustrate the actual position and shape of the thin film 1113, FIGS. 12A and 12B schematically show the film. FIG. 12A shows the device where part of the thin film 1113 is removed.

The preferred basic structure of the device has been described. This embodiment employs the following device.

The substrate 1101 is made of soda-lime glass, and the device electrodes 1102 and 1103 is made of an Ni thin film. The electrode thickness d is 1,000 Å and the electrode interval L is 2 $\mu$m.

The fine particle film is made of Pd or PdO as a main material, and has a thickness of about 100 Å and a width W of 100 $\mu$m.

Next, a method of manufacturing the preferred flat surface-conduction emission type electron-emitting device will be described.

FIGS. 13A to 13E are sectional views for explaining the manufacturing steps of the surface-conduction emission type electron-emitting device. The same reference numerals as in FIGS. 12A and 12B denote the same parts.

Figure 13A:
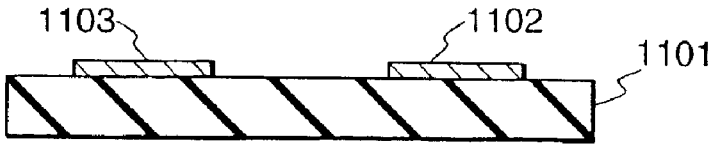
FIGS. 13A to 13E are sectional views, respectively, showing the steps in manufacturing the flat surface-conduction emission type electron-emitting device in the embodiment.

(1) First, as shown in FIG. 13A, the device electrodes 1102 and 1103 are formed on the substrate 1101. In forming the device electrodes 1102 and 1103, the substrate 1101 is fully washed with a detergent, pure water and an organic solvent, and the material of the device electrodes is deposited on the substrate 1101. (As a deposition method, a vacuum film formation technique such as evaporation and sputtering is used.) Then, the deposited electrode material is patterned using photolithography etching into a pair of device electrodes (1102 and 1103) shown in FIG. 13A.

Figure 13B:
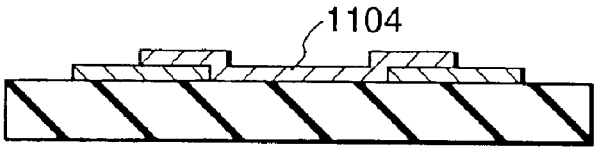

(2) As shown in FIG. 13B, the conductive thin film 1104 is formed. In forming the conductive thin film 1104, an organic metal solvent is applied to the substrate in FIG. 13A, dried, and sintered to form a fine particle film. The fine particle film is patterned into a predetermined shape by photolithography etching. The organic metal solvent is an organic metal compound solvent containing a fine particle material for forming the conductive thin film as a main element. (More specifically, this embodiment uses Pd as a main element. In the embodiment, the coating method is dipping, but may be any other method such as a spinner or spraying method.)

The conductive thin film 1104 made of a fine particle film may be formed by vacuum evaporation, sputtering, or chemical vapor-phase deposition, instead of the organic metal solvent coating method used in this embodiment.

Figure 13C:
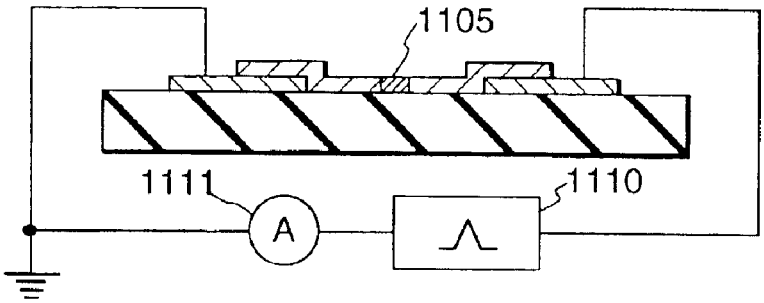

(3) Then, as shown in FIG. 13C, an appropriate voltage is applied from a forming processing power source 1110 between the device electrodes 1102 and 1103, and forming processing is performed to form the electron-emitting portion 1105.

In forming processing, a voltage is applied to a conductive thin film 1104 made of a fine particle film to appropriately destroy, deform, or deteriorate part of the conductive thin film, thereby changing the film into a structure suitable for electron emission. Then, a proper fissure is formed in the thin film at a portion (i.e., electron-emitting portion 1105) changed into the structure suitable for electron emission in the conductive thin film made of the fine particle film. The electrical resistance measured between the device electrodes 1102 and 1103 greatly increases after the electron-emitting portion 1105 is formed, compared to that before the electron-emitting portion 1105 is formed.

Figure 14:
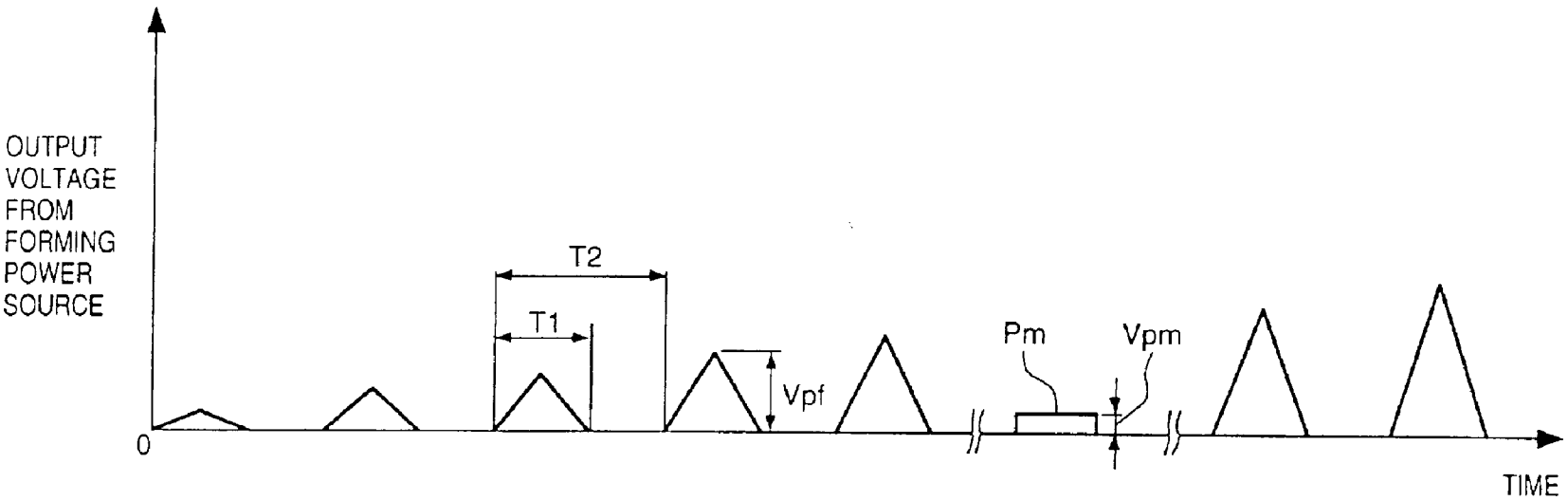
FIG. 14 is a graph showing the application voltage waveform in forming processing.

The electrification method will be explained in more detail with reference to FIG. 14 showing an example of the waveform of an appropriate voltage applied from the forming power source 1110. When forming processing is done for the conductive thin film made of a fine particle film, a pulse-like voltage is preferable. In this embodiment, as shown in FIG. 14, a triangular-wave pulse having a pulse width T1 is continuously applied at a pulse interval T2. At this time, a peak value Vpf of the triangular-wave pulse is sequentially increased. A monitor pulse Pm for monitoring the formation state of the electron-emitting portion 1105 is inserted between triangular-wave pulses at appropriate intervals, and a flowing current is measured by a galvanometer 1111.

In this embodiment, the vacuum atmosphere is set to $10^{-5}$ Torr; the pulse width T1, to 1 msec; and the pulse interval T2, to 10 msec. The peak value Vpf is increased by 0.1 V every pulse. Every application of five triangular-wave pulses, the monitor pulse Pm is inserted. To avoid adverse influence on forming processing, a monitor pulse voltage Vpm is set to 0.1 V. When the electrical resistance between the device electrodes 1102 and 1103 reaches $1\times10^{6}$ Ω, i.e., the current measured by the galvanometer 1111 upon application of the monitor pulse reaches $1\times10^{-7}$ A or less, electrification for forming processing is terminated.

Note that the above method is preferable for the surface-conduction emission type electron-emitting device of this embodiment. In case of changing the design of the surface-conduction emission type electron-emitting device such as the material and thickness of the fine particle film ands the device electrode interval L, the electrification conditions are preferably changed in accordance with the changed design.

Figure 13D:
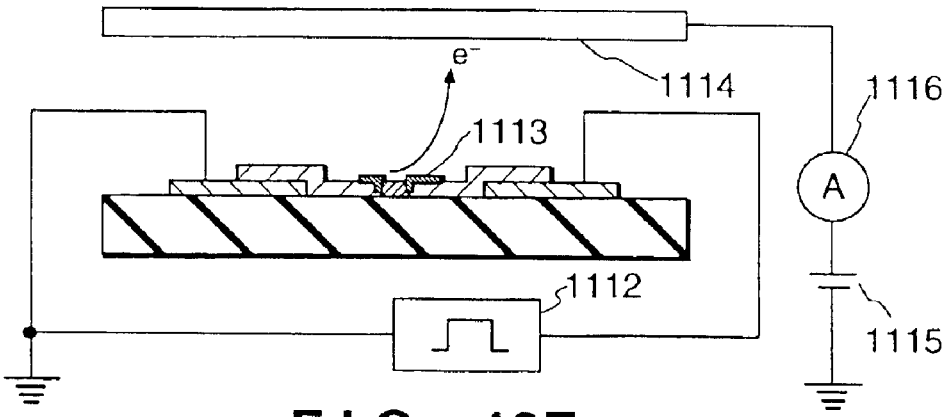

(4) Next, as shown in FIG. 13D, an appropriate voltage is applied from an activation power source 1112 between the device electrodes 1102 and 1103, and activation processing is performed to improve electron-emitting characteristic. In activation processing, a voltage is applied to the electron-emitting portion 1105 formed by forming processing in proper conditions to deposit carbon or a carbon compound around the electron-emitting portion 1105. (In FIG. 13D, the deposit of carbon or a carbon compound is represented as a material 1113.) Activation processing increases the emission current at the same application voltage typically 100 times or more the emission current before activation processing.

More specifically, the voltage pulse is periodically applied in a vacuum atmosphere of $10^{-4}$ to $10^{-5}$ Torr to deposit carbon or carbon compound mainly derived from an organic compound present in the vacuum atmosphere. The deposit 1113 is any of graphite monocrystalline, graphite polycrystalline, amorphous carbon or mixture thereof. The thickness of the deposit 1113 is 500 Å or less, and more preferably 300 Å or less.

Figure 15A:
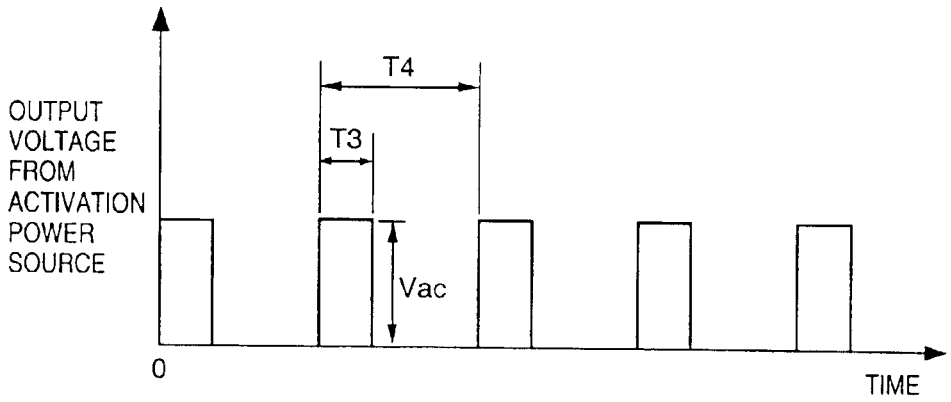
FIGS. 15A and 15B are graphs, respectively, showing changes in application voltage waveform and emission current Ie in the activation processing.

The electrification method will be described in more detail with reference to FIG. 15A showing an example of the waveform of an appropriate voltage applied from the activation power source 1112. In this embodiment, activation processing is done by periodically applying a rectangular wave of a predetermined voltage. A rectangular-wave voltage Vac is set to 14 V; a pulse width T3, to 1 msec; and a pulse interval T4, to 10 msec. Note that the above electrification conditions are preferable for the surface-conduction emission type electron-emitting device of the embodiment. In the case of changing the design of the surface-conduction emission type electron-emitting device, the electrification conditions are preferably changed in accordance with the changed design.

In FIG. 13D, reference numeral 1114 denotes an anode electrode connected to a DC high-voltage power source 1115 and galvanometer 1116 to capture an emission current Ie emitted from the surface-conduction emission type electron-emitting device. When the substrate 1101 is incorporated into the display panel 101 before activation processing, the fluorescent surface of the display panel is used as the anode electrode 1114. While a voltage is applied by the activation power source 1112, the galvanometer 1116 measures the emission current Ie to monitor the progress of activation processing and control operation of the activation power source 1112.

Figure 15B:
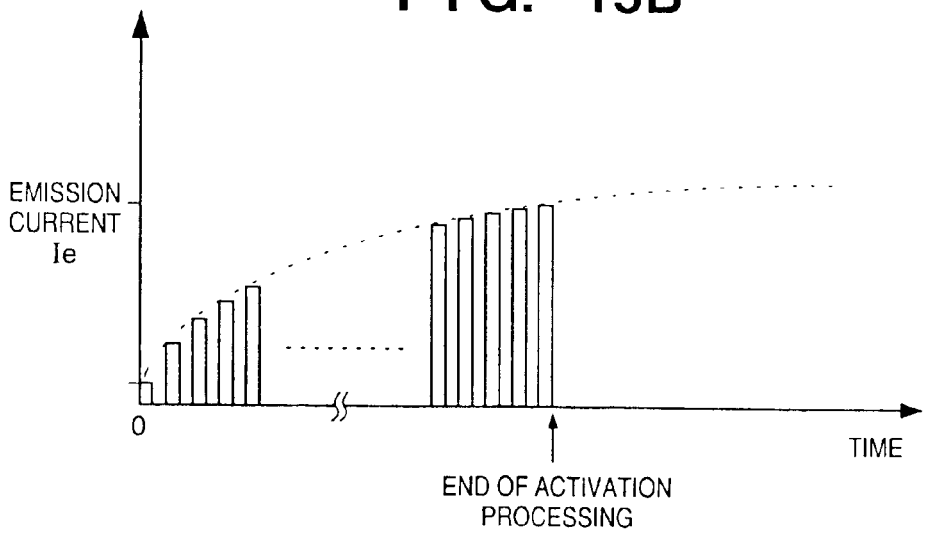

FIG. 15B shows an example of the emission current Ie measured by the galvanometer 1116. After the pulse voltage is applied from the activation power source 1112, the emission current Ie increases with the elapse of time, gradually comes into saturation, and almost never increases then. At the substantial saturation point, application of the voltage from the activation power source 1112 stops to terminate activation processing.

Note that the above electrification conditions are preferable for the surface-conduction emission type electron-emitting device of the embodiment. In case of changing the design of the surface-conduction emission type electron-emitting device, the conditions are preferably changed in accordance with the changed design.

Figure 13E:
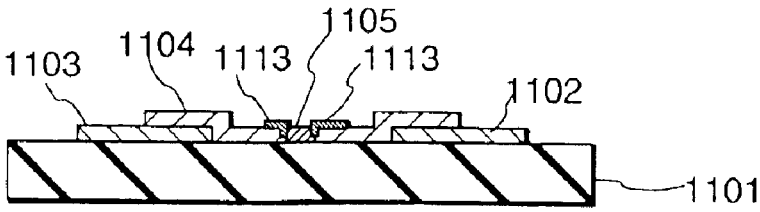

In this manner, the surface-conduction emission type electron-emitting device shown in FIG. 13E is manufactured.

(Step Surface-Conduction Emission Type Electron-Emitting Device)

Next, another typical structure of the surface-conduction emission type electron-emitting device where an electron-emitting portion or its peripheral portion is formed of a fine particle film, i.e., a step surface-conduction emission type electron-emitting device will be described.

Figure 16:
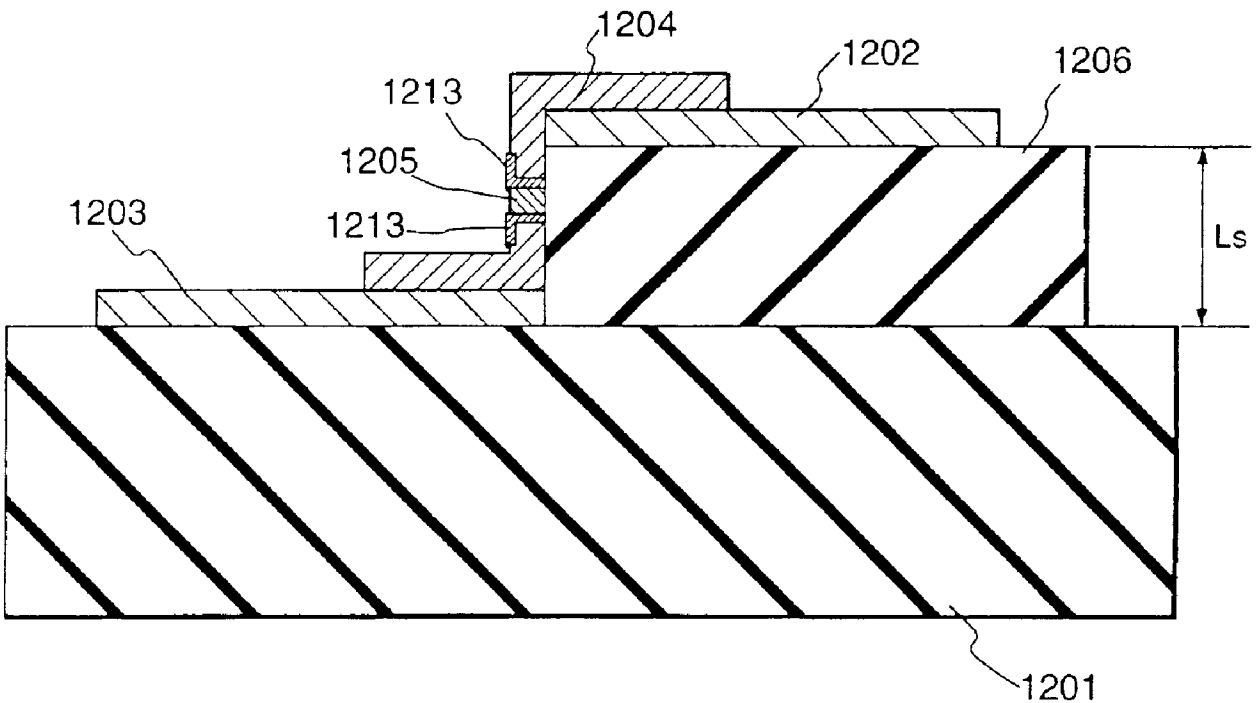
FIG. 16 is a sectional view showing a step surface-conduction emission type electron-emitting device used in the embodiment.

FIG. 16 is a sectional view schematically showing the basic construction of the step surface-conduction emission type electron-emitting device. In FIG. 16, reference numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by forming processing; and 1213, a thin film formed by activation processing.

The step device is different from the above-described flat device in that one of the device electrodes (1202 in this embodiment) is formed on the step-forming member 1206 and the conductive thin film 1204 covers the side surface of the step-forming member 1206. In the step structure, the device interval L in FIG. 12A is set as a height difference Ls corresponding to the height of the step-forming member 1206. Note that the substrate 1201, device electrodes 1202 and 1203, conductive thin film 1204 using a fine particle film can adopt the materials given in the explanation of the flat surface-conduction emission type electron-emitting device. The step-forming member 1206 is made of an electrically insulating material such as $SiO_2$.

Next, a method of manufacturing the step surface-conduction emission type electron-emitting device will be described with reference FIGS. 17A to 17F which are sectional views showing the manufacturing steps. In these figures, reference numerals of the respective parts are the same as those in FIG. 16.

Figure 17A:
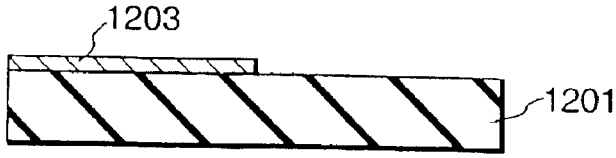
FIGS. 17A to 17F are sectional views, respectively, showing the steps in manufacturing the step surface-conduction emission type electron-emitting device.

(1) First, as shown in FIG. 17A, the device electrode 1203 is formed on the substrate 1201.

Figure 17B:
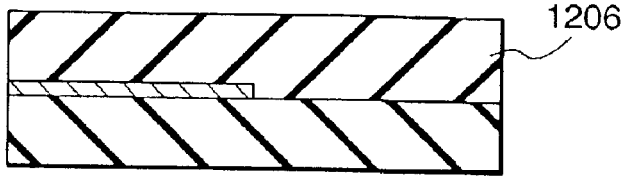

(2) As shown in FIG. 17B, an insulating layer for forming the step-forming member is deposited. The insulating layer may be formed by sputtering, e.g., $SiO_2$, but may be formed by a film formation method such as vacuum evaporation or printing.

Figure 17C:
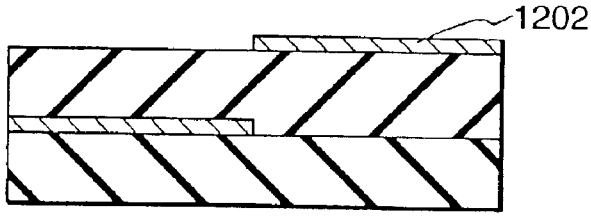

(3) Next, as shown in FIG. 17C, the device electrode 1202 is formed on the insulating layer.

Figure 17D:
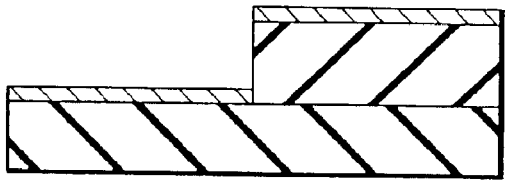

(4) Next, as shown in FIG. 17D, part of the insulating layer is removed by using, e.g., etching, to expose the device electrode 1203.

Figure 17E:
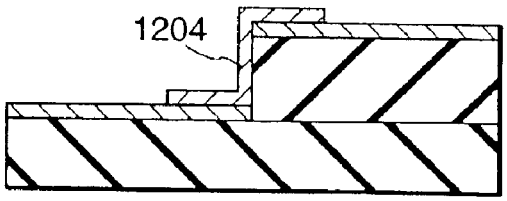

(5) Next, as shown in FIG. 17E, the conductive thin film 1204 using a fine particle film is formed using a film formation technique such as the coating method, similarly to the above-described flat device.

(6) Similar to the flat device, forming processing is done to form an electron-emitting portion. (The same forming processing as in the flat device described with reference to FIG. 13C is performed.)

(7) Similar to the flat device, activation processing is done to deposit carbon or a carbon compound around the electron-emitting portion. (The same activation processing as in the flat device described with reference to FIG. 13D is performed.).

Figure 17F:
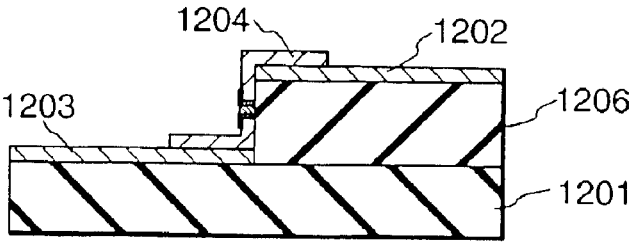

As described above, the step surface-conduction emission type electron-emitting device shown in FIG. 17F is manufactured.

(Characteristics of Surface-Conduction Emission Type Electron-Emitting Device Used in Display Apparatus)

The structure and manufacturing method of the flat surface-conduction emission type electron-emitting device and those of the step surface-conduction emission type electron-emitting device have been described. Next, the characteristics of the device used in the display apparatus will be described.

Figure 18:
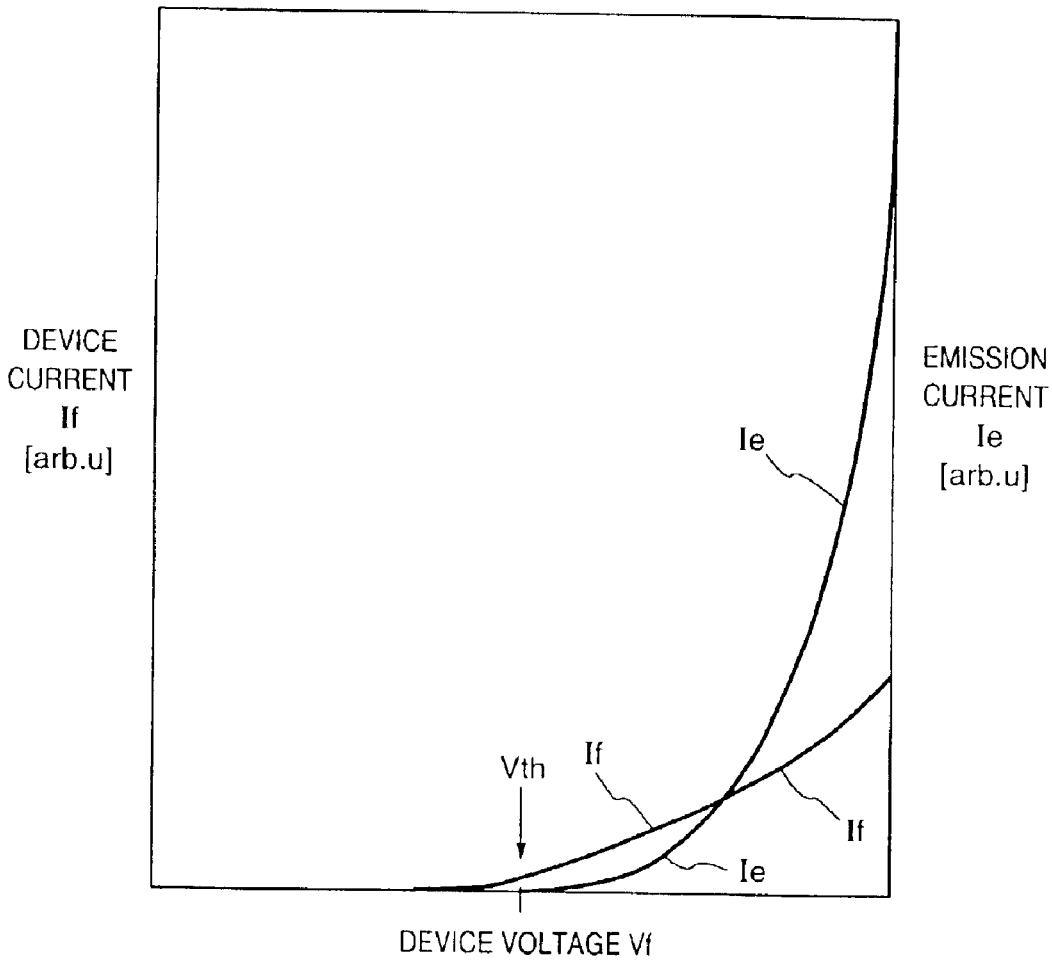
FIG. 18 is a graph showing the typical characteristics of the surface-conduction emission type electron-emitting device used in the embodiment.

FIG. 18 shows a typical example of (emission current Ie) to (device application voltage Vf) characteristic and (device current If) to (device application voltage Vf) characteristic of the surface-conduction emission type electron-emitting device used in the display apparatus of this embodiment. Note that the emission current Ie is much smaller than the device current If, and it is difficult to illustrate the emission current Ie by the same measure as the device current If. In addition, these characteristics change upon changes in design parameters such as the size and shape of the device. For these reasons, two lines in the graph of FIG. 18 are respectively given in arbitrary units.

Regarding the emission current Ie, the surface-conduction emission type electron-emitting device used in the display apparatus has the following three characteristics.

First, when a given voltage (to be referred to as "threshold voltage Vth") or more is applied to the device, the emission current Ie drastically increases, but almost no emission current Ie is detected at a voltage lower than the threshold voltage Vth. That is, regarding the emission current Ie, the device has a nonlinear characteristic based on the clear threshold voltage Vth.

Second, the emission current Ie changes depending on the device application voltage Vf, and thus can be controlled by changing the device voltage Vf.

Third, the emission current Ie is output quickly from the device in response to the device application voltage Vf. Accordingly, the charge amount of electrons emitted from the device can be controlled by changing the application time of the voltage Vf.

The surface-conduction emission type electron-emitting device of this embodiment having these three characteristics can be preferably applied to the display apparatus. For example, in a display apparatus having a large number of devices formed in correspondence with the pixels of the display screen, the first characteristic allows sequentially scanning the display screen and displaying an image. In other words, the threshold voltage Vth or more is appropriately applied to a driven device in accordance with a desired emission luminance, while a voltage lower than the threshold voltage Vth is applied to an unselected device. Devices to be driven are sequentially switched to sequentially scan the display screen and display an image.

The second or third characteristic allows controlling the emission luminance, and thus a multi-level display can be realized.

As described above, the multi electron source constituted by arranging these surface-conduction emission type electron-emitting devices in a simple matrix has the structure shown in FIGS. 8 and 9.

The arrangement of the image display apparatus having the display panel 101 constituted by arranging the surface-conduction emission type electron-emitting devices of this embodiment will be explained.

Figure 19:
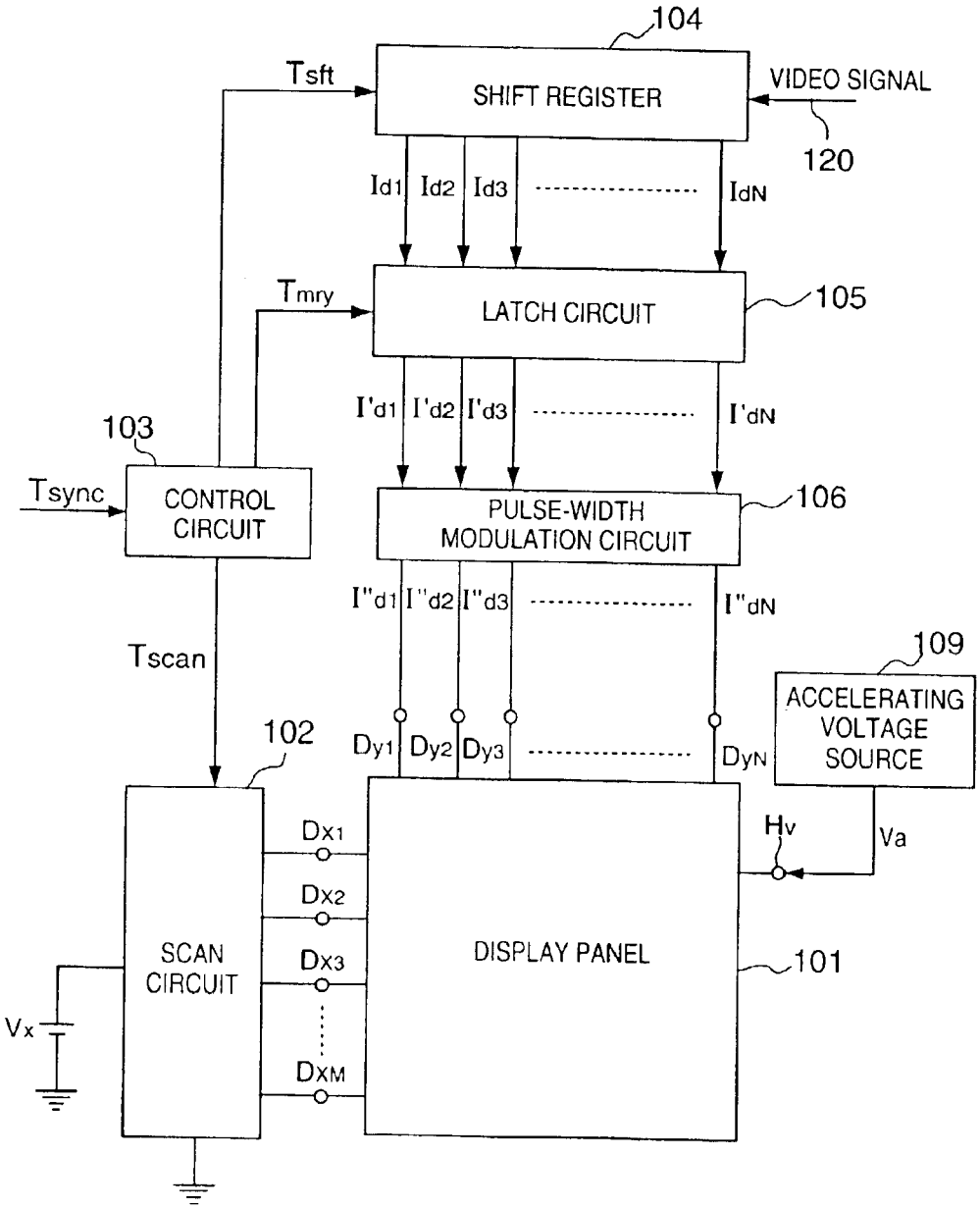
FIG. 19 is a block diagram showing the arrangement of a driving circuit for the image display apparatus according to the embodiment of the present invention.
Figure 20:
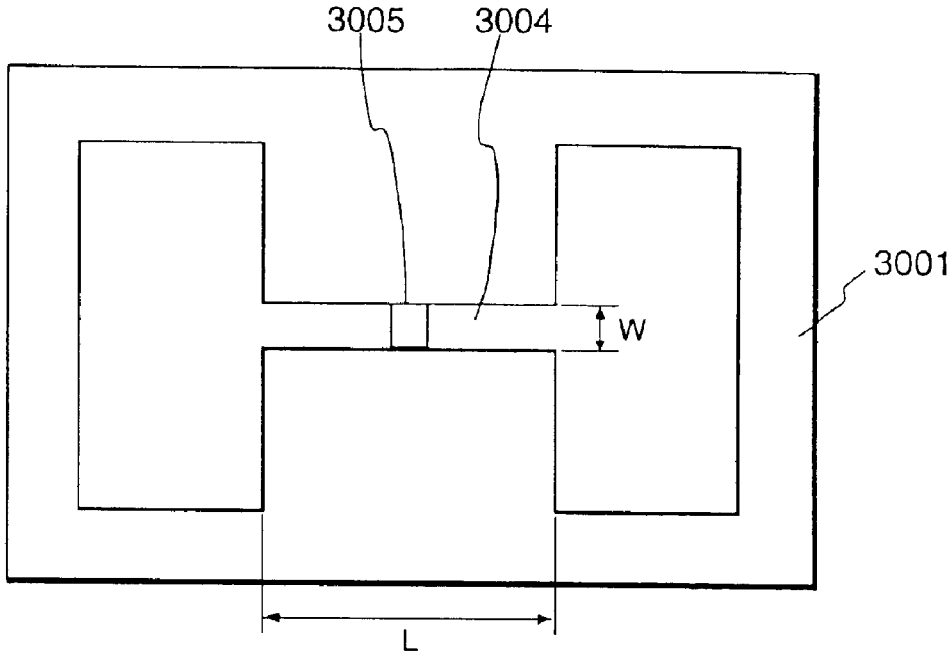
FIG. 20 is a view showing an example of a conventional surface-conduction emission type electron-emitting device.
Figure 21:
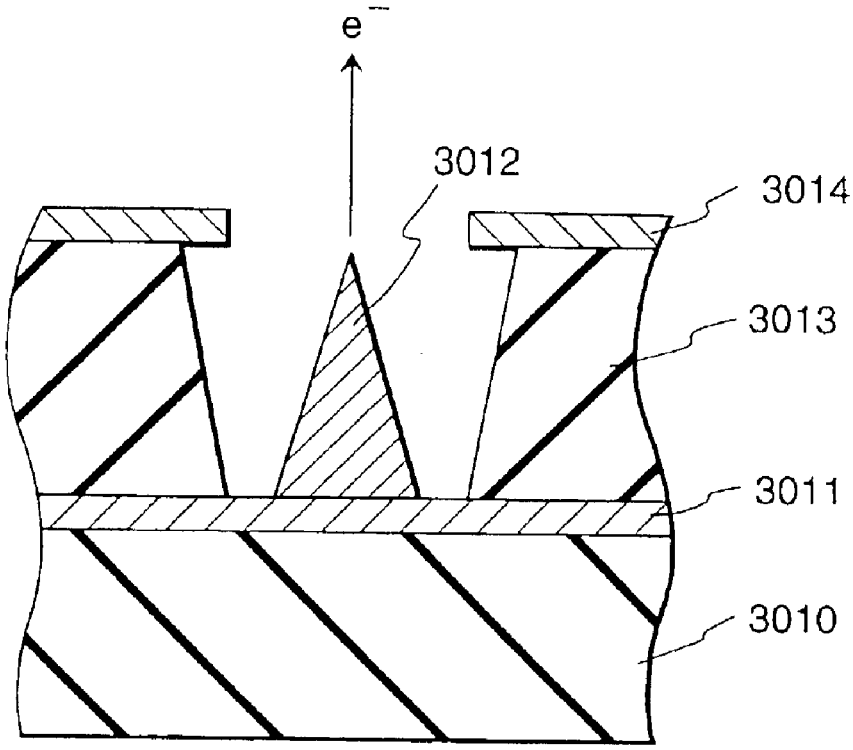
FIG. 21 is a view showing an example of a conventional FE type device.
Figure 22:
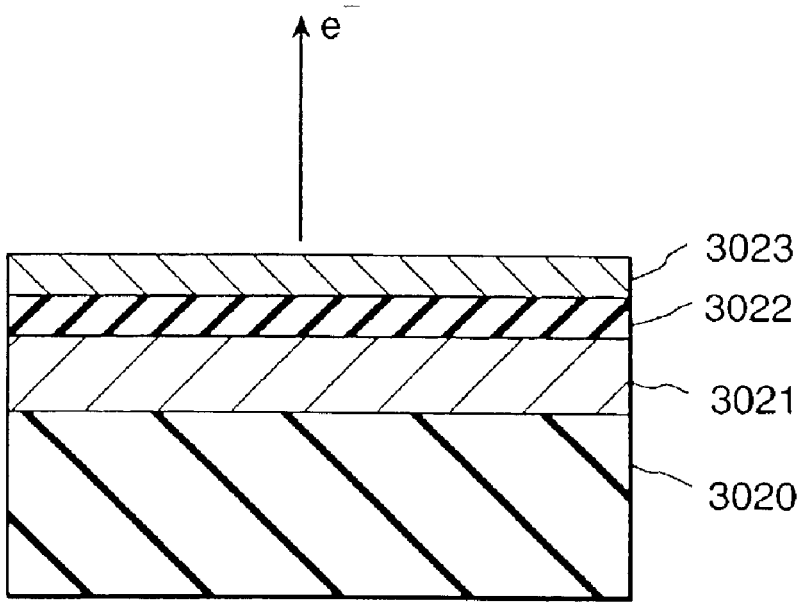
FIG. 22 is a view showing an example of a conventional MIM type device.

In FIG. 19, the display panel 101 is connected to an external driving circuit via the row wiring terminals Dx1 to DxM connected to the row wirings of the display panel 101, and the column wiring terminals Dy1 to DyN connected to the column wirings of the display panel 101. The row wiring terminals Dx1 to DxM receive from a scan circuit 102 scan signals for sequentially selecting and driving the multi electron source on the display panel 101, i.e., the surface-conduction emission type electron-emitting devices arranged in an M×N matrix in units of lines. The column terminals Dy1 to DyN receive modulation signals for controlling, in accordance with an input video signal, electrons emitted by the electron-emitting devices on one line selected by the scan signals applied from the scan circuit 102 to the row wirings.

The control circuit 103 matches operations of respective circuits with each other so as to attain a proper display based on an externally input image signal. An externally input video signal 120 includes a composite video signal of image data and a sync signal, like an NTSC signal, and a video signal of separate image data and a separate sync signal. In this embodiment, the latter video signal will be described. Note that the former video signal can also be processed similarly to this embodiment by providing a well-known sync separation circuit to separate image data and a sync signal Tsync, and inputting the image data and sync signal to a shift register 104 and control circuit 103, respectively.

The control circuit 103 generates control signals such as a horizontal sync signal Tscan, latch signal Tmry, and shift clock Tsft for respective circuits on the basis of the sync signal Tsync input externally.

Image signal (luminance data) contained in the externally input video signal is input to the shift register 104. The shift register 104 serial/parallel-converts in units of lines of an image the image data serially input in a time-series manner. The shift register 104 serially receives and holds the image data in synchronism with the control signal (shift signal) Tsft input from the control circuit 103. One-line image data (corresponding to driving data for N electron-emitting devices) converted into parallel signals by the shift register are output as parallel signals Id1 to IdN to a line memory 105.

The line memory 105 is a memory circuit for storing 1-line image data for a necessary time, and properly stores the parallel signals Id1 to Idn in accordance with the control signal Tmry sent from the control circuit 103. The image data stored in the line memory 105 are output as parallel signals I'd1 to I'dn to a pulse width modulation circuit 106. In accordance with these parallel signals I'd1 to I'dn, the pulse width modulation circuit 106 outputs as I"d1 to I"dN, voltage signals modulated in pulse width in accordance with the image data (I'd1 to I'dn) with a predetermined amplitude (voltage value).

More specifically, the pulse width modulation circuit 106 outputs a voltage pulse having a larger pulse width for a higher luminance level of image data. For example, this circuit 106 outputs a voltage pulse having an amplitude of 7.5 V and a pulse width of 30 μsec for the maximum luminance and 0.12 μsec for the minimum luminance. The output signals I"d1 to I"dN are applied to the column wiring terminals Dy1 to DyN of the display panel 101.

The high-voltage terminal Hv of the display panel 101 receives a DC voltage Va of, e.g., 5 kV from an accelerating voltage source 109.

The scan circuit 102 will be described next. This circuit 102 incorporates M switching devices. Each switching device selects either an output voltage from a DC voltage source Vx or 0 V (ground level), and is electrically connected to a corresponding one of the terminals Dx1 to DxM of the display panel 101. These switching devices are switched based on the control signal Tscan output from the control circuit 103. In practice, the scan circuit 102 can be easily constituted by a combination of switching devices such as FETs. Note that the DC voltage source Vx outputs a predetermined voltage so as to make the driving voltage applied to a non-scanned device be equal to or lower than the electron-emitting threshold Vth on the basis of the characteristics of the electron-emitting device shown in FIG. 18. The control circuit 103 matches operations of respective circuits so as to attain a proper display on the basis of an externally input image signal.

The shift register 104 and line memory 105 may be of a digital or analog signal type because they can only serial/parallel-convert and store an image signal at predetermined speeds.

In the image display of this embodiment having the above arrangement, a voltage is applied to the electron-emitting devices via the terminals Dx1 to DxM and Dy1 to DyN to emit electrons. A high voltage is applied to the metal back 1019 or transparent electrode (not shown) via the high-voltage terminal Hv to accelerate electrons. The accelerated electrons collide against the fluorescent film 1018 to emit light, thereby forming an image.

The arrangement of the image forming apparatus is merely an example of the image forming apparatus to which this embodiment can be applied. Various changes and modifications of the arrangement can be made within the spirit and scope of the present invention. Although the input signal is an NTSC signal, the input signal is not limited to this. For example, the input signal may be a PAL signal, SECAM signal, or TV signal (high-definition TV of the MUSE scheme or the like) using a larger number of scan lines.

Examples of the present invention will be described in detail.

Each example used a multi electron source constituted by arranging, in a matrix by M row-direction wirings and N column-direction wirings, N×M (N=3,072 and M=1,024) surface-conduction emission type electron-emitting devices each having an electron-emitting portion in a conductive fine particle film between electrodes (see FIG. 7).

EXAMPLE 1

A spacer 20 used in Example 1 was formed as follows.

Figure 1A:
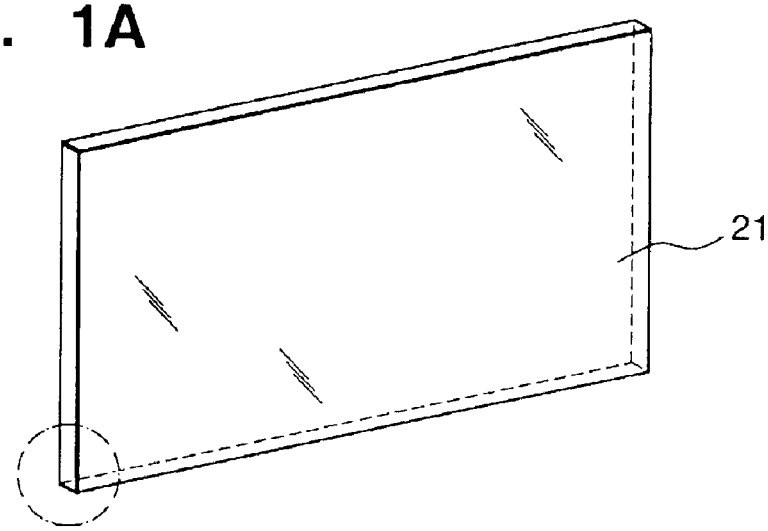
FIGS. 1A to 1D are views for explaining the shape of a spacer according to an embodiment of the present invention.
Figure 1B:
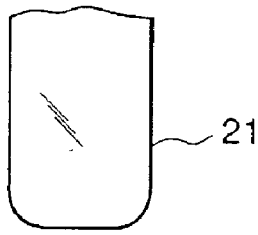

A soda-lime glass plate identical to those used for a face plate and rear plate 1015 was adopted as a spacer preform, and processed by the heating/stretching method shown in FIG. 30 into a spacer substrate 21 having a sectional shape as shown in FIGS. 1A and 1B, and FIG. 3D. FIG. 1B is an enlarged view showing the end portion of the side surface of the spacer substrate 21 circled in FIG. 1A in the direction of thickness.

As shown in FIG. 26, the spacer substrate 21 formed in Example 1 had a height H of 3 mm, a thickness D of 0.2 mm, and a length L of 40 mm. As shown in FIG. 26, a glass preform 501 used in Example 1 was a flat soda-lime glass plate having a height H of 150 mm and a thickness D of 10 mm. To attain a sectional area ratio of 1:1/2500 between the preform 501 and final spacer substrate 21, the feed velocity v1 and drawing velocity v2 were respectively set to 4 μm/min and 10 mm/min. The heating temperature of a heater 502 was set to 600° C., and the glass preform 501 was cut into a length L of 40 mm after the drawing step.

The edge of the spacer substrate 21 obtained by the heating/stretching method was 0.02 mm in radius r of curvature. Note that the height H, thickness D, and length L have the same definitions as in FIG. 26.

The procedures of forming a low-resistance film (electrode) 25 by dipping will be explained with reference to FIGS. 2A to 2E.

Figure 2A:
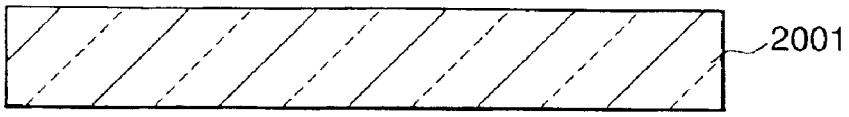
FIGS. 2A to 2E are views showing a method of applying a low-resistance film to the spacer according to the embodiment.
Figure 2B:
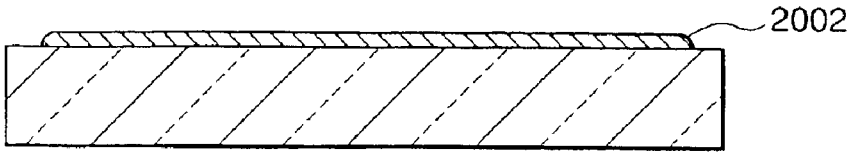
Figure 2C:
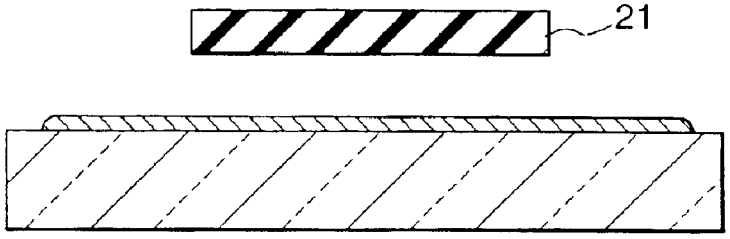
Figure 2D:
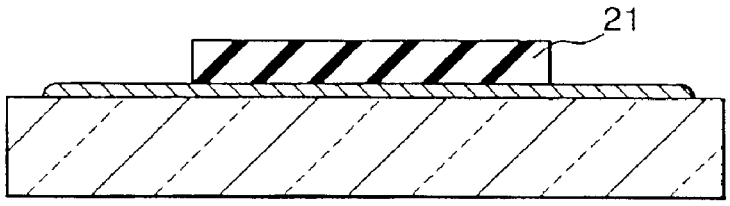
Figure 2E:
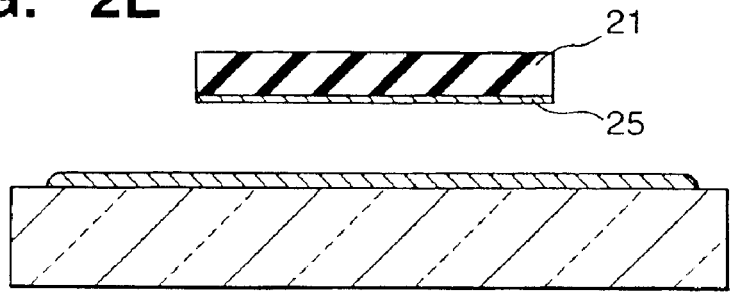

After chemical washing using pure water, IPA, and acetone, an organometallic salt-dissolved Pt paste (viscosity: 30 kcP) available from N.E. Chemcat was spread into a thin film on a thick 100×100×5 t glass plate 2001 having undergone UV ozone cleaning by a bar coater available from RK Print-instrumental Corp., as shown in FIG. 2B. At this time, the film thickness of a spread solution 2002 was 40 μm. As shown in FIGS. 2C, 2D, and 2E, the spacer substrate 21 was vertically moved down and dipped into the spread solution 2002 so as to make a 40 mm×0.2 mm surface (end surface) be parallel to the spread surface. Then, the spacer substrate 21 was vertically moved up to transfer the spread solution.

Figure 1C:
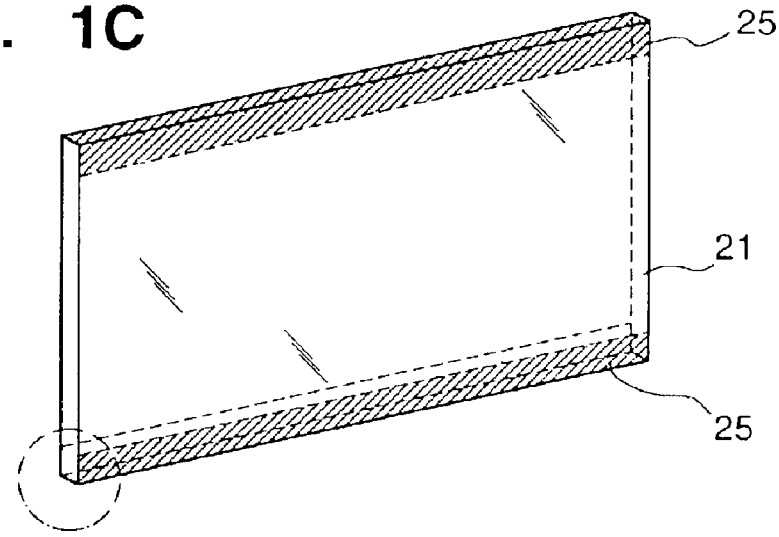
Figure 1D:
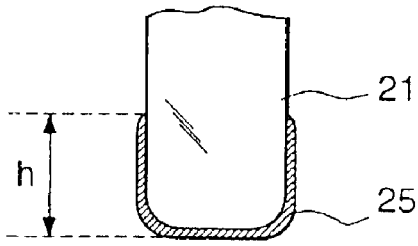

The series of spread, dipping, and transfer operations were done again for an opposite surface (end surface). After that, the spacer substrate 21 was dried at 120° C. for 10 min, and sintered at 600° C. for 10 min to form low-resistance films (electrodes) 25 on two, upper and lower end surfaces, as shown in FIGS. 1C and 1D. FIG. 1D is an enlarged view showing the spacer end portion circled in FIG. 1C.

The low-resistance film (electrode) 25 had a height h of about 200 μm, and a sheet resistance of 1 Ω/□. Then, Cr and Al targets were simultaneously sputtered as a high-resistance film 22 with an RF power supply onto the surface of the spacer substrate 21, thereby forming a Cr—Al alloy nitride film to a thickness of 200 nm. This sputter gas was a gas mixture of Ar and $N_2$ at 1:2, and the total pressure was 1 mTorr. A film simultaneously formed under the same conditions had a sheet resistance R of $2\times10^9$ Ω/□. Example 1 is not limited to this, and can adopt various materials and manufacturing methods for the high-resistance film 22.

The obtained spacer 20 was defined as a spacer 20*a*.

Light reflection was confirmed on the low-resistance film (electrode) 25 of the obtained spacer 20. In addition, no partial peeling was confirmed in the boundary region, i.e., the edge between the end surface and side surface of the spacer substrate 21, and the low-resistance film (electrode) 25 exhibited good coverage.

Example 1 manufactured a display panel 101 incorporating the spacer 20 like the one shown in FIG. 7.

The method of manufacturing the display panel 101 will be described in detail.

A substrate 1011 on which row-direction wiring electrodes 1013, column-direction wiring electrodes 1014, insulating layers (not shown) between these electrodes, and device electrodes 1102 and 1103 and conductive thin films 1104 of surface-conduction emission type electron-emitting devices were formed was fixed to a rear plate 1015. The spacers 20 prepared in the above manner were fixed parallel to the row-direction wirings 1013 on the row-direction wirings 1013 of the substrate 1011 at an equal interval. A face plate 1017 having a fluorescent film 1018 and metal back 1019 formed on the inner surface was set about 3 mm above the substrate 1011 via a side wall 1016. The joint portions between the rear plate 1015, face plate 1017, side wall 1016, and spacers 20 were fixed. Frit glass (not shown) was applied to the joint portion between the substrate 1011 and rear plate 1015, the joint portion between the rear plate 1015 and side wall 1016, and the joint portion between the face plate 1017 and side wall 1016, and sintered in air at 400° C. to 500° C. for 10 min or more to seal an airtight container. The spacers 20 were placed on the row-direction wirings 1013 (line width: about 300 μm) on the substrate 1011 side, and on the metal back 1019 on the face plate 1017 side via conductive frit glass (not shown) containing a conductive filler or conductive material such as a metal. At the same time as sealing the airtight container, the conductive frit glass was sintered in air at 400° C. to 500° C. for 10 min or more to attain electrical connection.

In Example 1, as shown in FIG. 10A, the fluorescent film 1018 adopted a stripe shape in which fluorescent substances of respective colors extended in the column direction (Y direction), and black conductive members 1010 were formed not only between the fluorescent substances of the respective colors (R, G, and B) but also between pixels so as to separate them in the Y direction. The spacers 20 were placed on the black conductive members 1010 (line width: about 300 μm) parallel to the row direction (X direction) via the metal back 1019. In sealing, the fluorescent substances of the respective colors must correspond to respective devices formed on the substrate 1011, so that the rear plate 1015, face plate 1017, and spacers 20 were aligned with high precision.

The interior of the completed airtight container was evacuated to a satisfactory vacuum degree by a vacuum pump via an exhaust pipe (not shown). Then, the devices were energized via terminals Dx1 to DxM and Dy1 to DyN, row-direction wiring electrodes 1013, and column-direction wiring electrodes 1014 to perform the above-described forming processing and activation processing, thereby manufacturing a multi electron source. The exhaust pipe (not shown) was heated and fused by a gas burner at a vacuum degree of about $10^{-6}$ Torr to seal the envelope (airtight container). Finally, getter processing was done to maintain the vacuum degree after sealing.

In the completed image display apparatus using the display panel 101 as shown in FIG. 7, a scan signal and modulation signal were supplied to the cold cathodes (surface-conduction emission type electron-emitting devices) 1012 via the terminals Dx1 to DxM and Dy1 to DyN to emit electrons. A high voltage was applied to the metal back 1019 via a high-voltage terminal Hv to accelerate the emitted electron beam and collide the electrons against the fluorescent film 1018. Then, the fluorescent substances of the respective colors (R, G, and B in FIG. 10A) were excited to emit light, thereby displaying an image. The application voltage Va to the high-voltage terminal Hv was applied up to a limit voltage for causing discharge within the range of 3 kV to 12 kV. The application voltage Vf to the wirings 1013 an 1014 was 14 V. When the display panel 101 could be continuously driven by applying a voltage of 8 kV or more to the high-voltage terminal Hv, the breakdown voltage was determined to be high.

In this case, no discharge occurred up to 9-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

EXAMPLE 2

Example 2 used a spacer substrate 21 identical to that formed in Example 1, and formed a low-resistance film (electrode) 25 having a height h of 200 μm, following the same formation method as in Example 1 except that a spread solution for coating the low-resistance film (electrode) 25 was spread by a 40-μm thickness gauge arranged parallel to a 0.2-t thick stainless doctor blade. Example 2 formed a high-resistance film 22 by sputtering, similar to Example 1. The formed spacer 20 was defined as a spacer 20*b*. Light reflection was confirmed on the low-resistance film (electrode) 25 of the spacer 20. In addition, no partial peeling was confirmed in the boundary region, i.e., the edge between the end surface and side surface of the spacer substrate 21, and the low-resistance film (electrode) 25 exhibited good coverage.

Example 2 manufactured a display panel 101 using a rear plate having electron-emitting devices and the like, similar to Example 1, and executed high-voltage application and device driving under the same conditions as in Example 1.

In this case, no discharge occurred up to 9-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

EXAMPLE 3

Example 3 used a spacer substrate 21 identical to that formed in Example 1, and formed a low-resistance film (electrode) 25 having a height h of 10 μm, following the same formation method as in Example 1 except that a spread solution for coating the low-resistance film (electrode) 25 was diluted with a terpene-based solvent and spread by spin coating. Example 3 formed a high-resistance film 22 by sputtering, similar to Example 1. The formed spacer 20 was defined as a spacer 20*c*. The diluted spread solution had a viscosity of 1 kcP. Light reflection was confirmed on the low-resistance film 25 of the spacer 20. In addition, no partial peeling was confirmed in the boundary region, i.e., the edge between the end surface and side surface of the spacer substrate 21, and the low-resistance film (electrode) 25 exhibited good coverage. Example 3 manufactured a display panel using a rear plate having electron-emitting devices and the like, similar to Example 1, and executed high-voltage application and device driving under the same conditions as in Example 1.

In this case, no discharge occurred up to 10-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

EXAMPLE 4

Example 4 used a spacer substrate 21 identical to that formed in Example 1, and formed a low-resistance film (electrode) 25 having a height of 100 μm, following the same formation method as in Example 1 except that a solution prepared by dissolving, in a silica binder, fine particles of tin oxide doped with Sb having an average diameter of 10 nm that is available from Sumitomo Osaka Cement Co., Ltd. was spread by a bar coater as a spread solution for coating the low-resistance film. Example 4 formed a high-resistance film 22 by sputtering, similar to Example 1. The formed spacer 20 was defined as a spacer 20*d*. The spread solution had a viscosity of 10 cP. Light reflection was confirmed on the low-resistance film (electrode) 25 of the spacer 20. In addition, no partial peeling was confirmed in the boundary region, i.e., the edge between the end surface and side surface of the spacer substrate 21, and the low-resistance film (electrode) 25 exhibited good coverage. Example 4 manufactured a display panel 101 using a rear plate having electron-emitting devices and the like, similar to Example 1, and executed high-voltage application and device driving under the same conditions as in Example 1.

In this case, no discharge occurred up to 9-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance, that may influence the electron orbit.

EXAMPLE 5

Example 5 used a spacer substrate 21 identical to that formed in Example 1, and formed a low-resistance film (electrode) 25, following the same formation method as in Example 1. The low-resistance film (electrode) 25 was partially etched using aqua regia heated to 80° C. as an etchant up to a position apart by a distance h' of 150 μm from the side surface of the spacer substrate 21 in the direction of thickness (the processing (removal) step of the electrode 25). At the same time, the edge of the low-resistance film was patterned to have the radius of curvature (FIGS. 32B and 33). As a result, the low-resistance film (electrode) 25 having a height h' of 150 μm was formed. Then, Example 5 formed a high-resistance film 22 by sputtering, similar to Example 1. The formed spacer 20 was defined as a spacer 20*e*. Light reflection was confirmed on the low-resistance film (electrode) 25 of the spacer 20*e*. In addition, no partial peeling was confirmed in the boundary region, i.e., the edge between the end surface and side surface of the spacer substrate 21, and the low-resistance film (electrode) 25 exhibited good coverage. Example 5 manufactured a display panel 101 using a rear plate having electron-emitting devices and the like, similar to Example 1, and executed high-voltage application and device driving under the same conditions as in Example 1.

In this case, no discharge occurred up to 10-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

EXAMPLE 6

Example 6 prepared a spacer 20 having a low-resistance film (electrode) 25 formed following the same method as in Example 5, but performed the processing (removal) step of the electrode 25 in Example 5 using a laser processing device. The processed electrode 5 had the same shape as in Example 5. Example 6 formed the low-resistance film (electrode) 25 in this fashion, and formed a high-resistance film 22 by sputtering, similar to Example 1. The formed spacer 20 was defined as a spacer 20*f*. Light reflection was confirmed on the low-resistance film (electrode) 25 of the spacer 20. In addition, no partial peeling was confirmed in the boundary region, i.e., the edge between the end surface and side surface of a spacer substrate 21, and the low-resistance film (electrode) 25 exhibited good coverage.

Example 6 manufactured a display panel 101 using a rear plate having electron-emitting devices and the like, similar to Example 1, and executed high-voltage application and device driving under the same conditions as in Example 1. In this case, no discharge occurred up to 10-kV driving near the spacer 20. Further, emission spot lines including the emission spots of electrons emitted by a cold cathode 1012 near the spacer 20*f* were two-dimensionally formed at an equal interval, and a vivid color image could be displayed with high color reproducibility. This means that the spacer 20 did not cause any electric field disturbance that may influence the electron orbit.

EXAMPLE 7

A soda-lime glass plate identical to those used for a face plate and rear plate 1015 was adopted as a spacer preform, and processed by the heating/stretching method shown in FIG. 5 into a spacer substrate 21 having a height H of 3 mm, a thickness D of 0.2 mm, and a length L of 40 mm. Example 7 formed by the heating/stretching method the edge of the spacer substrate (FIG. 26 and FIG. 3D) which was 4 $\mu$m in radius r of curvature.

Example 7 formed a low-resistance film (electrode) 25 having a height of 200 $\mu$m, following the same formation method as in Example 1, and formed a high-resistance film 22 by sputtering, similar to Example 1. The formed spacer 20 was defined as a spacer 20*g*. Light reflection was confirmed on the low-resistance film (electrode) 25 of the spacer 20. In addition, no partial peeling was confirmed in the boundary region, i.e., the edge between the end surface and side surface of the spacer substrate 21, and the low-resistance film (electrode) 25 exhibited good coverage.

Example 7 manufactured a display panel 101 using a rear plate having electron-emitting devices and the like, similar to Example 1, and executed high-voltage application and device driving under the same conditions as in Example 1. In this case, no discharge occurred up to 10-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

EXAMPLE 8

The spacer substrate was an alumina substrate prepared by tapering the boundary, i.e., the edge between the end surface and side surface of a spacer substrate 21 at 45° up to a region 10 $\mu$m apart from the edge by polishing (FIG. 3A). Example 8 formed a low-resistance film (electrode) 25 having a height of 200 $\mu$m on the obtained substrate, following the same formation method as in Example 1, and formed a high-resistance film 22 by sputtering, similar to Example 1. The formed spacer 20 was defined as a spacer 20*h*. Light reflection was confirmed on the low-resistance film (electrode) 25 of the spacer 20. In addition, no partial peeling was confirmed in the boundary region, i.e., the edge between the end surface and side surface of the spacer substrate 21, and the low-resistance film (electrode) 25 exhibited good coverage.

Example 8 manufactured a display panel 101 using a rear plate having electron-emitting devices and the like, similar to Example 1, and executed high-voltage application and device driving under the same conditions as in Example 1. In this case, no discharge occurred up to 10-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

EXAMPLE 9

The boundary, i.e., the edge between the end surface and side surface of a soda-lime glass spacer substrate 21 was tapered at 45° up to a region 10 $\mu$m apart from the edge by polishing (FIG. 3A).

Example 9 formed a low-resistance film (electrode) 25 having a height of about 200 $\mu$m on the spacer substrate 21, following the same formation method as in Example 1, and formed a high-resistance film 22 by sputtering, similar to Example 1. The formed spacer 20 was defined as a spacer 20*i*. Light reflection was confirmed on the low-resistance film (electrode) 25 of the spacer 20. In addition, no partial peeling was confirmed in the boundary region, i.e., the edge between the end surface and side surface of the spacer substrate 21, and the low-resistance film (electrode) 25 exhibited good coverage.

Example 9 manufactured a display panel 101 using a rear plate having electron-emitting devices and the like, similar to Example 1, and executed high-voltage application and device driving under the same conditions as in Example 1. In this case, no discharge occurred up to 10-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

EXAMPLE 10

As shown in FIG. 26, Example 10 employed as a spacer substrate 21 a soda-lime glass substrate polished to make all the six surfaces (side surfaces, end surfaces, and side surfaces in the direction of thickness) of a spacer substrate 21 be perpendicular to each other. Example 10 formed a low-resistance film (electrode) 25 having a height of 200 $\mu$m on the spacer substrate 21, following the same formation method as in Example 1, and formed a high-resistance film 22 by sputtering, similar to Example 1. The formed spacer 20 was defined as a spacer 20*j*. Light reflection was confirmed on the low-resistance film (electrode) 25 of the spacer 20. However, the edge between the end surface and side surface of the spacer substrate 21, the low-resistance film (electrode) 25 partially exhibited poor coverage.

Example 10 manufactured a display panel 101 using a rear plate having electron-emitting devices and the like, similar to Example 1, and executed high-voltage application and device driving under the same conditions as in Example 1. In this case, when a high voltage applied to the metal back was increased up to 10 kV, similar to the above examples, discharge was partially observed in the Example 10. However, as far as the high voltage applied to the metal back was equal to or lower than 8 kV, emission spot lines including the emission spots of electrons emitted by a cold cathode 1012 near the spacer 20*j* were two-dimensionally formed at an equal interval, and a vivid color image could be displayed with high color reproducibility. This means that as far as the high voltage applied to the metal back was equal to or lower than 8 kV, the spacer 20 did not cause any electric field disturbance that may influence the electron orbit. No emission spot disturbance was observed even with partially poor edge coverage because the remaining low-resistance film was in well contact with the boundary region, and thus the common potential was maintained at the upper end of the low-resistance film.

Comparative Example

A comparative example used a spacer substrate 21 having acute edge as shown in FIG. 26, and formed a low-resistance film (electrode) 25, following the formation method shown in FIGS. 6A to 6D. The process will be explained in detail.

Figure 6A:
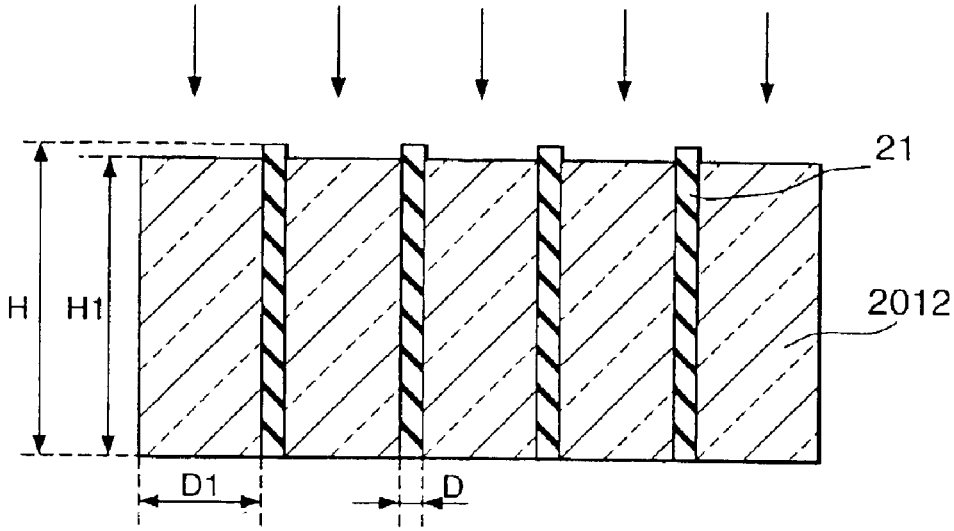
FIGS. 6A to 6D are views for explaining the vapor phase formation process of the low-resistance film used in a comparative example with respect to examples of the present invention.

A plurality of spacer substrates 21 were fixed to sandwich the two side surfaces of each spacer substrate 21 by a glass fixing jig 2012 (FIG. 6A). The glass fixing jig 2012 had a thickness D1 of 1.1 mm, a height H1 of 2.8 mm, and a length L1 of 42 mm. The spacer substrate had a thickness D of 0.2 mm, a height H of 3 mm, and a length L of 40 mm.

Figure 6B:
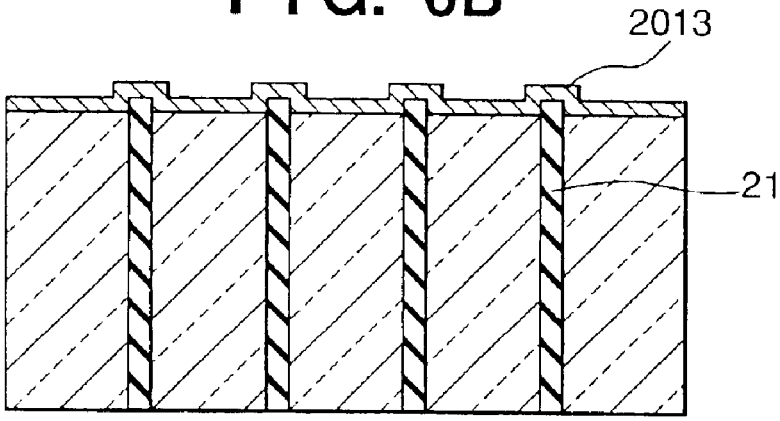
Figure 6C:
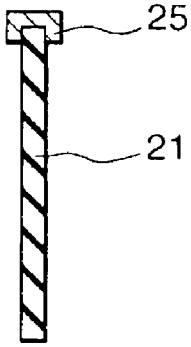

A 10-nm thick Ti film 2013 was formed at the end portion of the spacer substrate exposing from the glass fixing jig 2012, and a 200-nm thick Pt film 2013 was epitaxially sputtered (FIGS. 6B and 6C). By this step, a 200-$\mu$m high low-resistance film (electrode) 25 was formed.

Figure 6D:
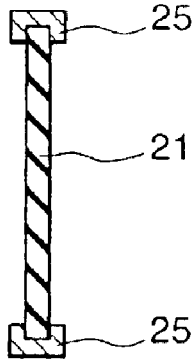

Similar to this step, a low-resistance film (electrode) 25 was formed on the opposite end portion of the spacer substrate 21 (FIG. 6D).

In this step, the Ti film was necessary as an underlayer for improving the adhesion property of the Pt film. After that, the comparative example formed a high-resistance film 22 by sputtering, similar to Example 1.

The formed spacer 20 was defined as a spacer 20*k*. Light reflection was confirmed on the low-resistance film (electrode) 25 of the spacer 20. However, partial peeling was confirmed in the boundary region, i.e., the edge between the end surface and side surface of the spacer substrate 21, and the low-resistance film (electrode) 25 exhibited partially poor coverage.

The comparative example manufactured a display panel 101 using a rear plate having electron-emitting devices and the like, similar to Example 1, and executed high-voltage application and device driving under the same conditions as in Example 1. In this case, no discharge occurred up to 7-kV driving near the spacer 20. Further, emission spot lines including the emission spots of electrons emitted by a cold cathode 1012 near the spacer 20 were two-dimensionally formed at an equal interval, and a vivid color image could be displayed with high color reproducibility. This means that the spacer 20 did not cause any electric field disturbance that may influence the electron orbit.

The spacers 20*a* to 20*j* having the low-resistance films (electrodes) 25 that were formed in Examples 1 to 10, and the spacer 20*k* formed in the comparative example were compared in formation method, electrical contact, emission spot displacement, and discharge resistance to find that the spacer 20*k* in the comparative example required an exhaust device in forming the low-resistance film (electrode) 25, suffered poor adhesion property with the glass substrate by only Pt sputtering, and required another process for forming an underlayer.

The low-resistance film (electrode) 25 in the comparative example was slightly lower in dielectric breakdown voltage than the low-resistance film (electrode) 25 formed by dipping in Examples 1 to 10 because of the following reason. The low-resistance film (electrode) 25 formed by dipping had a tapered section thinner toward the peripheral portion. To the contrary, the edge of the patterned low-resistance film (electrode) 25 formed by sputtering had a right-angle section or a projection such as a flash extending outward from the spacer while peeling the low-resistance film (electrode) 25 from the mask. This causes the electric field to readily concentrate at the projection in the electron source.

The spacer 20*j* exhibited a high breakdown voltage and proper beam emission position. However, on this spacer 20*j*, the coverage of the low-resistance film (electrode) 25 was poor at the edge of spacer substrate 21. Considering the mass production yield and the like, R processing at the edge of the spacer substrate 21 as shown in FIG. 3D is effective to improve the coverage.

Any low-resistance film (electrode) 25 formed by Examples 1 to 10 can be simply, easily formed. The electrical contact of the obtained low-resistance film (electrode) 25 is high, the discharge resistance is also high, and thus the display quality by an electron beam can be improved. This low-resistance film (electrode) 25 is particularly effective for a manufacturing process demanded for mass production and low cost, and an electron source using this process.

As described above, the vapor phase formation method as the method of forming the low-resistance film (electrode) 25 in Examples 1 to 10 has the following effects. Because of the absence of the evacuation step, ① The apparatus cost can be reduced.

② The tact time can be shortened.

If the low-resistance film (electrode) 25 is in a metastable state after exhaustion, pressure reduction, film formation, and an air leakage, and another film is formed in an unstable transient state, problems such as peeling of the low-resistance film (electrode) 25 may occur. To prevent this, the low-resistance film (electrode) 25 must be relaxed to a stable state. This is assumed to concern the structure and surface activation of the low-resistance film (electrode) 25, and particularly the stabilization of dehydration/hydration. However, this unstable state can be avoided using heating and sintering without any vacuum step.

③ The utilization efficiency of a raw material is high.

Processing of forming smooth continuous surfaces, such as processing of forming the boundary region (edge) between the end surface and side surface of the spacer substrate 21 into an arcuated shape, has the following effects.

The coverage of the low-resistance film (electrode) 25 at the edge, i.e., boundary region between the end surface and side surface of the spacer substrate 21 can be improved.

Accordingly, good electrical contact can be attained between the end surface and side surface of the spacer substrate 21 without dividing the low-resistance film (electrode) 25 between them. In assembling the spacer in the electron source, charges on the spacer surface can be efficiently removed to the substrate surfaces of the FP and RP.

Consequently, a simple, low-cost manufacturing process can be realized. This further reduces the manufacturing costs of the spacer and electron source, and provides a low-cost image display apparatus with high display quality in which emission spot displacement caused by charge-up is suppressed.

As has been described above, the present invention can easily form a spacer having a low-resistance film (electrode) at low cost without using any exhaust device.

As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing a spacer provided between a face plate having an electrode and a rear plate having electron-emitting devices, comprising the steps of:

(A) preparing a spacer substrate with an edge including a tapered, chamfered or arcuated portion;

(B) preparing a liquid comprising a dispersed conductive material or dissolved conductive material;

(C) dipping the edge into the liquid; and (D) drying and/or baking the spacer substrate after said dipping step.

2. The method according to claim 1, wherein the viscosity of the liquid is not less than 10 cps.

3. A method of manufacturing a spacer provided between a face plate having an electrode and a rear plate having electron-emitting devices, comprising the steps of:

(A) preparing a spacer substrate with an end portion including a tapered, chamfered or arcuated portion;

(B) preparing a liquid comprising a metallic compound or metal;

(C) dipping the edge into the liquid; and (D) drying and/or baking the end portion after said dipping step.

4. The method according to claim 3, wherein the viscosity of the liquid is not less than 10 cps.

5. A method of manufacturing a flat panel display comprising a face plate having an electrode and a fluorescent film, a rear plate having a plurality of electron-emitting devices and a plurality of wirings, and a spacer disposed between the electrode and at least one of the wirings, comprising the steps of:

(A) preparing a face plate having an electrode and a phosphor;

(B) preparing a rear plate having a plurality of electron-emitting devices and a plurality of wirings;

(C) preparing a spacer substrate with an edge including a tapered, chamfered or arcuated portion;

(D) preparing a liquid comprising a dispersed conductive material or dissolved conductive material;

(E) dipping the edge into the liquid; and (F) drying and/or baking the spacer substrate after said dipping step.

6. The method according to claim 5, wherein the viscosity of the liquid is not less than 10 cps.

7. The method according to claim 5, wherein the fluorescent film includes three primary color fluorescent substances.

8. A method of manufacturing a flat panel display comprising a face plate having an electrode and a fluorescent film, a rear plate having a plurality of electron-emitting devices and a plurality of wirings, and a spacer disposed between the electrode and at least one of the wirings, comprising the steps of:

(A) preparing a face plate having an electrode and a phosphor;

(B) preparing a rear plate having a plurality of electron-emitting devices and a plurality of wirings;

(C) preparing a spacer substrate with an end portion including a tapered, chamfered or arcuated portion;

(D) preparing a liquid comprising a metallic compound or metal;

(E) dipping the end portion into the liquid; and (F) drying and/or baking the end portion after said dipping step.

9. The method according to claim 8, wherein the viscosity of the liquid is not less than 10 cps.

10. The method according to claim 8, wherein the fluorescent film includes three primary color fluorescent substances.

11. A method of manufacturing a flat panel display comprising a face plate structure having an anode, a rear plate structure having a cathode, and a spacer disposed between the face plate structure and the rear plate structure, comprising the steps of:

(A) preparing a face plate structure having an anode;

(B) preparing a rear plate structure having a cathode, wherein the cathode has an electron emitting structure;

(C) arranging a spacer between said face plate structure and the rear plate structure; and (D) producing a hermetically sealed container using the face plate structure, the rear plate structure and a seal structure, said arranging step (C) comprising the steps of:

(1) preparing a spacer substrate being polyhedron in shape, wherein the spacer substrate has at least one abutting surface for adjoining to a voltage defining structure and a non-abutting surface for not adjoining to the voltage defining structure, and an edge having a tapered or arcuated cross section between the abutting surface and the non-abutting surface;

(2) applying a conductive material-dispersed or conductive material-dissolved liquid to the abutting surface by a dipping method, wherein the conductive material-dispersed or conductive material-dissolved liquid is simultaneously applied to a plurality of surfaces of the polyhedron;

(3) drying and baking the conductive material-dispersed or conductive material-dissolved liquid so as to form a conductive layer, wherein the conductive layer is successively formed between the abutting surface and the non-abutting surface; and (4) mounting the spacer to either the face plate structure or rear plate structure after said drying and baking step.

12. The method according to claim 11, wherein the voltage defining structure includes a cathode or an anode.

13. The method according to claim 11, wherein in said applying step, the conductive material-dispersed or conductive material-dissolved liquid is simultaneously applied to at least three surfaces of the polyhedron.

14. The method according to claim 11, wherein in said applying step, the conductive material-dispersed or conductive material-dissolved liquid is simultaneously applied to at least five surfaces of the polyhedron.

15. The method according to claim 11, wherein the spacer is situated in a potential more than 25 kV/cm in an operation state of the flat panel display.

16. The method according to claim 11, wherein the viscosity of the conductive material-dispersed or conductive material-dissolved liquid is not less than 10 cps.

17. The method according to claim 11, wherein the viscosity of the conductive material-dispersed or conductive material-dissolved liquid is not less than 100 cps.

18. The method according to claim 11, wherein the viscosity of the conductive material-dispersed or conductive material-dissolved liquid is not less than 1000 cps.

19. A method of manufacturing a flat panel display comprising a face plate structure having an anode, a rear plate structure having a cathode, and a spacer disposed between the face plate structure and the rear plate structure, comprising the steps of:

(A) preparing a face plate structure having an anode;

(B) preparing a rear plate structure having a cathode, wherein the cathode has an electron emitting structure;

(C) arranging a spacer between the face plate structure and the rear plate structure; and (D) producing a hermetically sealed container using the face plate structure, the rear plate structure and a seal structure, said arranging step (C) comprising the steps of:

(1) preparing a spacer substrate being polyhedron in shape, wherein the spacer substrate has at last one abutting surface for adjoining to a voltage defining structure and a non-abutting surface for not adjoining to the voltage defining structure, and an end portion having a tapered or arcuated cross section between the abutting surface and the non-abutting surface;

(2) applying a conductive material-dispersed or conductive material-dissolved liquid to the abutting surface by a dipping method, wherein the conductive material-dispersed or conductive material-dissolved liquid is simultaneously applied to a plurality of surfaces of the polyhedron;

(3) drying and baking the conductive material-dispersed or conductive material-dissolved liquid so as to form a conductive layer, wherein the conductive layer is electrically connecting between the abutting surface and the non-abutting surface; and (4) mounting the spacer to either the face plate structure or rear plate structure after said drying and baking step.

20. The method according to claim 19, wherein the voltage defining structure includes a cathode or an anode.

21. The method according to claim 19, wherein in said applying step, the conductive material-dispersed or conductive material-dissolved liquid is simultaneously applied to at least three surfaces of the polyhedron.

22. The method according to claim 19, wherein in said applying step, the conductive material-dispersed or conductive material-dissolved liquid is simultaneously applied to at least five surfaces of the polyhedron.

23. The method according to claim 19, wherein the spacer is situated in a potential more than 25 kV/cm in an operation state of the first panel display.

24. The method according to claim 19, wherein the viscosity of the conductive material-dispersed or conductive material-dissolved liquid is not less than 10 cops.

25. The method according to claim 19, wherein the viscosity of the conductive material-dispersed or conductive material-dissolved liquid is not less than 100 cps.

26. The method according to claim 19, wherein the viscosity of the conductive material-dispersed or conductive material-dissolved liquid is not less than 1000 cps.

* * * * *

UNITED STATES PATENT AND TRADEMARK OFFICE

CERTIFICATE OF CORRECTION

PATENT NO. : 6,926,571 B2
APPLICATION NO. : 10/265232
DATED : August 9, 2005
INVENTOR(S) : Nobuhiro Ito et al.

Figure 27:
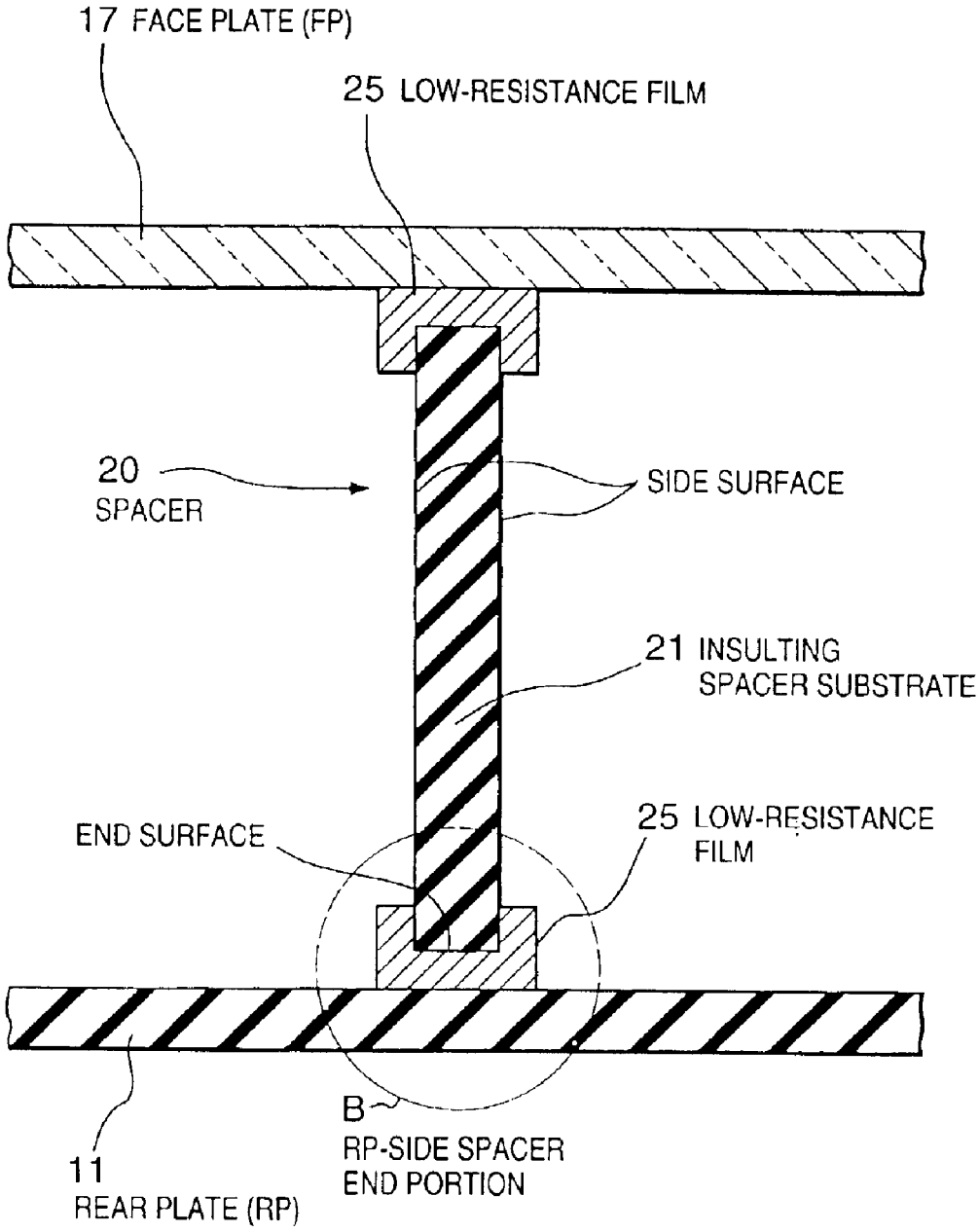
FIG. 27 is a schematic view showing an example of the low-resistance film formed on the spacer.

It is certified that error appears in the above-identified patent and that said Letters Patent is hereby corrected as shown below:

SHEET 27:

FIG. 27, "INSULTING" should read --INSULATING--.

COLUMN 22:

Line 29, "ands" should read --and--.

COLUMN 38:

Line 26, "10 cops." should read --10 cps.--.

Signed and Sealed this

Eighteenth Day of July, 2006

JON W. DUDAS
*Director of the United States Patent and Trademark Office*